US012616239B2

(12) United States Patent
Schaller et al.

(10) Patent No.: US 12,616,239 B2
(45) **Date of Patent: *May 5, 2026**

(54) AEROSOL-GENERATING ARTICLE WITH HOLLOW TUBULAR ELEMENT

(71) Applicant: PHILIP MORRIS PRODUCTS S.A., Neuchatel (CH)

(72) Inventors: Chrystophe Schaller, Neuchatel (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/267,250

(22) PCT Filed: Dec. 17, 2021

(86) PCT No.: PCT/EP2021/086643
§ 371 (c)(1),
(2) Date: Jun. 14, 2023

(87) PCT Pub. No.: WO2022/129607
PCT Pub. Date: Jun. 23, 2022

(65) Prior Publication Data

US 2024/0041101 A1 Feb. 8, 2024

(30) Foreign Application Priority Data

Dec. 18, 2020 (EP) ..... 20215841

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/027* (2013.01); *A24D 3/04* (2013.01); *A24D 3/17* (2020.01); *A24D 1/042* (2013.01)

(58) Field of Classification Search
CPC .... A24D 1/045; A24D 3/0237; A24D 3/0275; A24D 3/04; A24D 3/10; A24D 1/20
See application file for complete search history.

(56) References Cited

U.S. PATENT DOCUMENTS 3,396,733 A 8/1968 Frank
3,599,646 A * 8/1971 Berger ..... A24D 3/0283 131/342

(Continued)

FOREIGN PATENT DOCUMENTS

EP 0476969 3/1992
EP 18214844.5 * 12/2018 ..... A24D 1/20

(Continued)

OTHER PUBLICATIONS

Extended European Search Report for Application No. 20215841.6 dated Jun. 11, 2021, 8 pages.

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

An aerosol-generating article (1) comprising: a first element (10) comprising an aerosol-forming substrate (12); and a hollow tubular element (100) disposed downstream of the first element (10). The hollow tubular element (100) comprises: a peripheral portion (110) defining a hollow inner region (120) of the hollow tubular element (100); and a support element (130) formed from a sheet and extending from a first point (131) at the peripheral portion (110) across the hollow inner region (120) to a second point (132) at the peripheral portion (110). The hollow tubular element (100) has an average weight of about 10 milligrams per millimetre length or less.

15 Claims, 7 Drawing Sheets

(51) Int. Cl.

| | |
|---|---|
| ***A24D 1/04*** | (2006.01) |
| ***A24D 3/04*** | (2006.01) |
| ***A24D 3/17*** | (2020.01) |

(56) References Cited

U.S. PATENT DOCUMENTS

| | | | | |
|---|---|---|---|---|
| 3,894,545 | A | 7/1975 | Crellin | |
| 4,542,754 | A | 9/1985 | Cantrell | |
| 4,643,206 | A | 2/1987 | Reynolds | |
| 5,016,656 | A | 5/1991 | McMurtrie | |
| 5,105,837 | A | 4/1992 | Barnes | |
| 6,776,168 | B1 * | 8/2004 | Teufel | A24D 3/04 131/345 |
| 11,419,360 | B2 | 8/2022 | Klipfel | |
| 2008/0035162 | A1 | 2/2008 | Braunshteyn | |
| 2016/0331032 | A1 * | 11/2016 | Malgat | H05B 6/108 |
| 2020/0268043 | A1 | 8/2020 | Partouche | |
| 2022/0030935 | A1 * | 2/2022 | Uthurry | A24D 1/20 |

FOREIGN PATENT DOCUMENTS

| | | |
|---|---|---|
| FR | 2555866 | 12/1984 |
| JP | 4-263698 | 9/1992 |
| JP | 2018-531590 | 11/2018 |
| WO | WO 2012/022989 | 3/2012 |
| WO | WO 2013/098405 | 7/2013 |
| WO | WO 2013/120565 | 8/2013 |
| WO | WO 2015/007399 | 1/2015 |
| WO | WO 2015/007400 | 1/2015 |
| WO | WO 2015/176898 | 11/2015 |
| WO | WO 2019/063737 | 4/2019 |
| WO | WO 2019/220904 | 11/2019 |
| WO | WO 2020/200820 | 10/2020 |
| WO | WO 2021/233918 | 11/2021 |
| WO | WO 2022/074161 | 4/2022 |
| WO | WO 2022/074235 | 4/2022 |

OTHER PUBLICATIONS https://www.amazon.co.uk/Raw-Rolling-Papers-Booklets-Standard/dp/B005JFFY02/ref=sr_1_28?dchild=1&keywords=pre%2Brolled%2Bfilter%Btips&qid+1602149431&sr=8 28&th=1.

PCT International Search Report and Written Opinion PCT/EP2021/086643 dated Mar. 14, 2022 (11 pages).

Office Action issued in Japan for Application No. 2023-535514 dated Dec. 7, 2023 (7 pages). English translation included.

* cited by examiner

AEROSOL-GENERATING ARTICLE WITH HOLLOW TUBULAR ELEMENT

This application is a U.S. National Stage Application of International Application No. PCT/EP2021/086643 filed Dec. 17, 2021, which was published in English on Jun. 23, 2022, as International Publication No. WO 2022/129607 A1. International Application No. PCT/EP2021/086643 claims priority to European Application No. 20215841.6 dated Dec. 18, 2020.

The present invention relates to an aerosol-generating article comprising an aerosol-forming substrate and adapted to produce an inhalable aerosol upon heating.

Aerosol-generating articles in which an aerosol-forming substrate, such as a tobacco-containing substrate, is heated rather than combusted are known in the art.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is typically generated by the transfer of heat from a heat source to a physically separate aerosol-forming substrate or material, which may be located in contact with, within, around, or downstream of the heat source. During use of the aerosol-generating article, volatile compounds are released from the aerosol-forming substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-forming substrate. As an alternative, inductively heatable aerosol-generating articles comprising an aerosol-generating substrate and a susceptor element arranged within the aerosol-generating substrate have been proposed by WO 2015/176898.

Aerosol-generating articles in which a tobacco-containing substrate is heated rather than combusted present a number of challenges that were not encountered with conventional smoking articles. For example, it may be desirable to restrict movement of the aerosol-generating substrate within the aerosol-generating article, whilst still ensuring a sufficient level of air flow may pass through the aerosol-generating substrate and the aerosol-generating article. Restricting potential movement of the aerosol-generating substrate is particularly desirable since it may help to improve consistency of performance from one aerosol-generating article to another, for example by helping to increase the consistency of interaction between the aerosol-generating substrate and the heater element. This may be particularly relevant for aerosol-generating articles adapted to receive a heater blade, since the act of inserting of the heater blade may otherwise increase the likelihood of displacement of the aerosol-generating substrate.

WO 2013/098405 proposes to include a hollow tubular element immediately downstream of an aerosol-forming substrate. The hollow tubular element is provided in the form of an annular shaped hollow cellulose acetate tube. The hollow cellulose acetate tube is configured to resist downstream movement of the aerosol-forming substrate during insertion of a heating element of an aerosol-generating device into the aerosol-forming substrate. The empty space within the hollow cellulose acetate tube provides an opening for aerosol to flow from the aerosol-forming substrate towards the mouth end of the aerosol-generating article.

However, such hollow tubular elements may suffer from one or more of the drawbacks, such as one or more of inconsistencies of performance, restriction on one or both of material and design, manufacturing challenges, and undesirable RTD properties.

Therefore, it would be desirable to provide a new and improved aerosol-generating article, which is less likely to suffer from one or more of such drawbacks.

The present disclosure relates to an aerosol-generating article. The aerosol-generating article may comprise a first element. The first element may comprise an aerosol-forming substrate. The aerosol-generating article may comprise a hollow tubular element. The hollow tubular element may be disposed downstream of the first element. The hollow tubular element may comprise a peripheral portion. The peripheral portion may define a hollow inner region of the hollow tubular element. The hollow tubular element may comprise a support element. The support element may be formed from a sheet. The support element may extend from a first point at the peripheral portion. The support element may extend across the hollow inner region. The support element may extend to a second point at the peripheral portion. The hollow tubular element may have an average weight of about 10 milligrams per millimetre length or less.

According to the present invention, there is provided an aerosol-generating article. The aerosol-generating article comprises a first element. The first element comprises an aerosol-forming substrate. The aerosol-generating article further comprises a hollow tubular element. The hollow tubular element is disposed downstream of the first element. The hollow tubular element comprises a peripheral portion. The peripheral portion defines a hollow inner region of the hollow tubular element. The hollow tubular element also comprises a support element. The support element is formed from a sheet. The support element extends from a first point at the peripheral portion. The support element extends across the hollow inner region. The support element extends to a second point at the peripheral portion. The hollow tubular element has an average weight of about 10 milligrams per millimetre length or less.

The aerosol-generating article of the present invention comprises a hollow tubular element having a support element extending from a first point at its peripheral portion across its hollow inner region to a second point at its peripheral portion. The support element may act to provide a support barrier for at least part of the first element. In particular, the support element may act to provide a support barrier for at least part of the aerosol-forming substrate. This may reduce the availability of free space for material from the aerosol-forming substrate to be pushed into, when, for example, the aerosol-generating article interacts with an aerosol-generating device or when the aerosol-generating article is handled or transported. The interaction may involve insertion of the aerosol-generating article into the aerosol-generating device. Put another way, the support element may provide a support barrier, which prevents or restricts downstream movement of at least part of the aerosol-forming substrate. Consequently, in the aerosol-generating article of the present invention, it may be less likely that portions of aerosol-forming material will be pushed out of the aerosol-forming substrate, when the aerosol-generating article is being used. This may lead to a more consistent experience for a user.

Furthermore, because the support element is formed from a sheet and extends from a first point at the peripheral portion across the hollow inner region to a second point at the hollow inner region, the hollow tubular element may still retain a suitably sized opening for aerosol to flow from the aerosol-forming substrate towards the mouth end of the aerosol-generating article. This means that the hollow tubular element may still have a suitably low resistance to draw. This also means that the hollow tubular element may still have a suitably low filtration effect.

In addition, forming the support element from a sheet may provide flexibility in design of the support element and in particular, of where the support element provides its support barrier. This is because the flexibility of the sheet may enable it to be easily formed into a shape that is most suitable for providing a support barrier for the first element, and any components provided therein. For example, this advantage may be particularly beneficial for an aerosol-generating article having a susceptor element, which may be located in a number of positions within the first element. Thus, the flexibility in design of the support element and of where the support element provides its support barrier may mean that the support element may be designed to effectively support the first element, and any components provided therein.

Further, in comparison to prior art hollow acetate tubes, the hollow inner region of the hollow tubular element of the present invention may have a proportionally larger transverse cross-section. This may advantageously increase the porosity of the hollow tubular element. This may advantageously lead to less acceleration of the aerosol as it passes the hollow tubular element. This may mean the aerosol spends more time in the hollow inner region of the hollow tubular element, and thus may allow for greater cooling of the aerosol.

Further, in comparison to prior art hollow acetate tubes, the hollow tubular element of the present invention may require the use of less material, which may correspond to an overall lighter hollow tubular element. Further, in comparison to prior art hollow acetate tubes, the hollow tubular element of the present invention may be made from material which is more biodegradable, such as certain forms of paper.

Further, in comparison to prior art hollow acetate tubes, the hollow tubular element of the present invention may exhibit a lower resistance to draw when placed in an aerosol-generating article, and particularly when placed immediately downstream of the first element.

As used herein, the term "aerosol-generating article" denotes an article wherein an aerosol-forming substrate is heated to produce and deliver inhalable aerosol to a consumer.

As used herein, the term "aerosol-forming substrate" denotes a substrate capable of releasing compounds upon heating to generate an aerosol.

As used herein, the term "hollow tubular element" is used to denote a generally elongate element defining a lumen or airflow passage along a longitudinal axis thereof. In particular, the term "tubular" will be used in the following with reference to a tubular element having a tubular body with a substantially cylindrical cross-section and defining at least one airflow conduit establishing an uninterrupted fluid communication between an upstream end of the tubular body and a downstream end of the tubular body. However, it will be understood that alternative geometries (for example, alternative cross-sectional shapes) of the tubular body may be possible.

As used herein, the term "longitudinal" refers to the direction corresponding to the main longitudinal axis of the aerosol-generating article, which extends between the upstream and downstream ends of the aerosol-generating article.

As used herein, the term "transverse" refers to the direction that is perpendicular to the longitudinal axis of the aerosol-generating article. Any reference to the "cross section" of the aerosol-generating article or a component thereof refers to the transverse cross-section unless stated otherwise.

As used herein, the terms "upstream" and "downstream" describe the relative positions of elements, or portions of elements, of the aerosol-generating article in relation to the direction in which the aerosol is transported through the aerosol-generating article during use.

As used herein, the term "sheet" denotes a laminar element having a width and length substantially greater than the thickness thereof.

The peripheral portion is a peripheral portion of material. The peripheral portion may be formed from a sheet. The peripheral portion and the support element may be integrally formed from a sheet. In other words, the peripheral portion and the support element may be formed from the same sheet. The peripheral portion and the support element may be formed from separate sheets.

The peripheral portion may comprise a tube. The peripheral portion may be formed from a tube. The tube may be distinct from the sheet which forms the support element. The tube may be formed from a sheet that is the same as or distinct from the sheet which forms the support element. For example, the peripheral portion may comprise a tube which is distinct from the sheet that forms the support element; a first end of the sheet that forms the support element may be in contact with the tube up to a first point at the peripheral portion, where it deflects away from the tube and into the hollow inner region; a second end of the sheet that forms the support element may be in contact with the tube up to a second point at the peripheral portion, where it deflects away from the tube and into the hollow inner region; the portion of the sheet between the first point at the peripheral portion and the second point at the peripheral portion may form a support element which extends from the first point at the peripheral portion across the hollow inner region to the second point at the peripheral portion. In this instance, the peripheral portion comprises the portion of the sheet extending from the first end of the sheet to the first point at the peripheral portion, and the portion of the sheet extending from the second point at the peripheral portion to the second end of the sheet.

Where the peripheral portion comprises a tube, the sheet forming the support element may be attached to the tube by an adhesive at points where the sheet is in contact with the tube.

The peripheral portion may form an outer surface of the hollow tubular element. Where the peripheral portion is formed from a sheet, preferably the portion of the sheet forming the peripheral portion forms an outer surface of the hollow tubular element. Substantially the entirety of the portion of the sheet forming the peripheral portion may form an outer surface of the hollow tubular element. An outer surface of the hollow tubular element may be curved.

The support element may extend along part of the length of the hollow tubular element. Preferably, the support element extends from the upstream end of the hollow tubular element. This means that the support element may be at the end of the hollow tubular element closest to the first element. As such, the support element may be better able to prevent or restrict movement of the first element, and any components provided therein. Preferably, the support element extends to the downstream end of the hollow tubular element. The support element may extend along about 10 percent or more of the length of the hollow tubular element, preferably along about 40 percent or more of the length of the hollow tubular element, more preferably along about 80 percent or more of the length of the hollow tubular element. Most preferably, the support element extends along substantially the entire length of the hollow tubular element. As such, the support element may have a length equal to about the length of the hollow tubular element. This may provide the hollow tubular element with additional mechanical strength and stiffness along the entire length of the hollow tubular element.

The support element may have a length of about 4 millimetres or more, preferably about 6 millimetres or more, more preferably about 8 millimetres or more, or about 15 millimetres or more.

The support element may have a length of about 40 millimetres or less, preferably about 30 millimetres or less, more preferably about 20 millimetres or less.

The support element may have a length of between about 4 millimetres and about 40 millimetres, preferably between about 6 millimetres and about 30 millimetres, more preferably between about 8 millimetres and about 20 millimetres, or between about 15 millimetres and about 20 millimetres.

The support element may have a length of about 8 millimetres. The support element may have a length of about 18 millimetres.

The support element may depend from the peripheral portion along a first fold line of the sheet which forms the support element, wherein the first fold line resides at the first point at the peripheral portion. Advantageously, this may simplify manufacturing of the hollow tubular element and may provide a suitable support barrier for the first element, and any components provided therein.

The sheet which forms the support element may also form part of the peripheral portion. For example, a portion of the sheet adjacent to the first fold line and on the other side of the first fold line from the support element, may form part of the peripheral portion. This portion of the sheet may be attached to the remainder of the peripheral portion by an adhesive. The use of an adhesive may help to improve the mechanical strength of the hollow tubular element in one or both of the longitudinal direction and the transverse direction. As such, this may help to improve the hollow tubular element's ability to provide a support barrier and its resistance to collapse or deformation. The portion of the sheet adjacent to the first fold line, and on the other side of the first fold line from the support element, may form the entirety of the peripheral portion.

The first fold line may extend along part of the length of the hollow tubular element. In this case, the support element also extends along part of the length of the hollow tubular element. Preferably, the first fold line extends from the upstream end of the hollow tubular element. Preferably, the first fold line extends to the downstream end of the hollow tubular element. The first fold line may extend along about 10 percent or more of the length of the hollow tubular element, preferably along about 40 percent or more of the length of the hollow tubular element, more preferably along about 80 percent or more of the length of the hollow tubular element. Most preferably, the first fold line extends along substantially the entire length of the hollow tubular element.

The first fold line may be parallel to the longitudinal axis of the hollow tubular element. The first fold line may be non-parallel to the longitudinal axis of the hollow tubular element. The first fold line may be designed to be non-parallel to the longitudinal axis of the hollow tubular element in such a way that the internal projection induces a swirling air flow pattern within the cavity of the hollow tubular element.

Where a sheet comprises a fold line, the sheet may be deflected by an angle of greater than about 45 degrees about the fold line, greater than about 60 degrees about the fold line, greater than about 75 degrees about the fold line, or greater than about 90 degrees about the fold line.

The fold line may be a crease line. The sheet may comprise a score line aligned with the fold line to assist with folding of the sheet.

As used herein, the term "length" denotes the dimension of a component of the aerosol-generating article in the longitudinal direction. For example, it may be used to denote the dimension of the first element comprising the aerosol-forming substrate or the hollow tubular element in the longitudinal direction.

The first fold line may be the only fold line along which the support element depends from the peripheral portion.

The support element may comprise an end of the sheet. The end of the sheet may be in contact with the peripheral portion at the second point at the peripheral portion. The end of the sheet may be attached to the peripheral portion at the second point at the peripheral portion by an adhesive.

Preferably, the support element depends from the peripheral portion along a second fold line of the sheet, wherein the second fold line resides at the second point at the peripheral portion. This may provide the hollow tubular with sufficient mechanical strength and stiffness in one or both of the longitudinal direction and the transverse direction to prevent or restrict movement of at least part of the first element, and at least part of any components provided therein, without significant deformation of the hollow tubular element during at least one of handling, transport and use of the aerosol-generating article, for example during interaction of the aerosol-generating article with an aerosol-generating device and in particular, during insertion of the aerosol-generating article into the aerosol-generating device.

The second fold line may extend along part of the length of the hollow tubular element. The second fold line may extend along about 10 percent or more of the length of the hollow tubular element, preferably along about 40 percent or more of the length of the hollow tubular element, more preferably along about 80 percent or more of the length of the hollow tubular element. Most preferably, the second fold line extends along substantially the entire length of the hollow tubular element.

Preferably, the first fold line and the second fold line extend along the length of the hollow tubular element by about the same amount.

The first fold line and the second fold line may be parallel to each other. The first fold line and the second fold line may be non-parallel to each other.

Preferably, the first point at the peripheral portion and the second point at the peripheral portion have the same longitudinal position. That is, the first point at the peripheral portion and the second point at the peripheral portion are preferably in the same transverse cross-sectional plane.

The first point at the peripheral portion and the second point at the peripheral portion may be spaced apart from each other. The first point at the peripheral portion and the second point at the peripheral portion may be spaced apart from each other by about 0.05 millimetres or more, preferably about 0.3 millimetres or more, more preferably about 0.5 millimetres or more.

The first point at the peripheral portion and the second point at the peripheral portion may be spaced apart from each other by about 3 millimetres or less, preferably about 2.5 millimetres or less, more preferably about 2 millimetres or less.

The first point at the peripheral portion and the second point at the peripheral portion may be spaced apart from each other by between about 0.05 millimetres and about 3 millimetres, preferably between about 0.3 millimetres and about 2.5 millimetres, more preferably between about 0.5 millimetres and about 2 millimetres.

The first point at the peripheral portion and the second point at the peripheral portion may be spaced apart from each other around the circumference of the hollow tubular element by about 0.2 percent or more of the circumference of the hollow tubular element, preferably about 2 percent or more of the circumference of the hollow tubular element, more preferably about 3 percent or more of the circumference of the hollow tubular element.

The first point at the peripheral portion and the second point at the peripheral portion may be spaced apart from each other around the circumference of the hollow tubular element by about 12 percent or less of the circumference of the hollow tubular element, preferably about 10 percent or less of the circumference of the hollow tubular element, more preferably about 8 percent or less of the circumference of the hollow tubular element The first point at the peripheral portion and the second point at the peripheral portion may be spaced apart from each other around the circumference of the hollow tubular element by between about 0.2 percent and about 12 percent of the circumference of the hollow tubular element, preferably between about 2 percent and about 10 percent of the circumference of the hollow tubular element, more preferably between about 3 percent and about 9 percent of the circumference of the hollow tubular element.

The first point at the peripheral portion and the second point at the peripheral portion may be spaced apart from each other around the circumference of the hollow tubular element by about half of the circumference of the hollow tubular element. That is, the first point at the peripheral portion and the second point at the peripheral portion may be about diametrically opposed to each other.

The first point at the peripheral portion and the second point at the peripheral portion may be spaced apart from each other around the circumference of the hollow tubular element by between about 5 percent and about 50 percent of the circumference of the hollow tubular element, preferably between 10 percent and about 40 percent of the circumference of the hollow tubular element, more preferably between about 15 percent and about 30 percent of the circumference of the hollow tubular element.

The first point at the peripheral portion and the second point at the peripheral portion may be adjacent to each other. The first point at the peripheral portion and the second point at the peripheral portion may be spaced apart from each other by about zero millimetres. The first point at the peripheral portion and the second point at the peripheral portion may be in contact with each other. The first point at the peripheral portion and the second point at the peripheral portion may be attached to each other by an adhesive. The use of an adhesive may help to improve the mechanical strength of the hollow tubular element in one or both of the longitudinal direction and the transverse direction. As such, this may help to improve the hollow tubular element's resistance to collapse or deformation.

The support element may be in contact with the peripheral portion at a further point at the peripheral portion other than the first point at the peripheral portion and other than the second point at the peripheral portion. Where the support element is in contact with the peripheral portion, the support element may be attached to that point at the peripheral portion by an adhesive.

The support element may comprise a tip, the tip being positioned within the hollow inner region. The tip may be spaced apart from the peripheral portion. The tip may be spaced apart from the peripheral portion by about 0.6 millimetres or more, preferably about 2 millimetres or more, more preferably about 3 millimetres or more.

The tip may be spaced apart from the radial centre of the hollow tubular element by about 0.2 millimetres or more, preferably about 0.5 millimetres or more, more preferably about 1 millimetre or more.

The tip may be spaced apart from the radial centre of the hollow tubular element by about 3 millimetres or less, preferably about 2.5 millimetres or less, more preferably about 2 millimetres or less.

The tip may be spaced apart from the radial centre of the hollow tubular element by between about 0.2 millimetres and about 3 millimetres, preferably between about 0.5 millimetres and about 2.5 millimetres, more preferably between about 1 millimetre and about 2 millimetres.

The tip may reside at a point which is adjacent to a point at the peripheral portion. The tip may be in contact with the peripheral portion. The tip may reside at the radial centre of the hollow tubular element.

The tip may be positioned about equidistant from the first point at the peripheral portion and the second point at the peripheral portion.

As used herein, the term "radial centre" is used to refer to the centre of a transverse cross section of the hollow tubular element.

The tip may be pointed. For example, the support element may have a substantially triangular cross section.

The tip may be rounded. For example, the support element may have a substantially parabolic cross section.

The tip may be flat. For example, the support element may have a substantially trapezoidal cross section.

The support element may comprise a third fold line of the sheet. That is, the sheet forming the support element may comprise a third fold line between the first point at the peripheral portion and the second point at the peripheral portion. The support element may comprise a third fold line of the sheet between the first fold line and the second fold line. This may further strengthen the hollow tubular element in one or both of the longitudinal direction and the transverse direction to enable the hollow tubular element to withstand larger forces being applied to it in one or both of the longitudinal direction and the transverse direction before deforming substantially. As such, this may improve the hollow tubular element's ability to prevent or restrict movement of at least part of the first element, and at least part of any components provided therein.

The third fold line may reside at or adjacent to the peripheral portion. The third fold line may reside at or adjacent to the radical centre of the hollow tubular element.

The third fold line may define the tip of the support element.

The third fold line may be positioned about equidistant from the first fold line and the second fold line. The third fold line may be positioned closer to the first fold line than the second fold line.

Preferably, there is about the same amount of material of the sheet between the first fold line and the third fold line as there is between the second fold line and the third fold line. There may be less material of the sheet between the first fold line and the third fold line than there is between the second fold line and the third fold line.

A surface of the support element along the longitudinal direction may be substantially planar. As such, a cross section of the hollow tubular element may comprise a straight line corresponding to the substantially planar surface of the support element along the longitudinal direction. The substantially planar surface may extend from the first point at the peripheral portion. The substantially planar surface may extend to the second point at the peripheral portion. The substantially planar surface may extend from the first point at the peripheral portion to the second point at the peripheral portion. Where there is a first fold line of the sheet, the substantially planar surface may extend from the first fold line. Where there is a second fold line of the sheet, the substantially planar surface may extend to the second fold line. Where there is both a first fold line of the sheet and a second fold line of the sheet, the substantially planar surface may extend from the first fold line to the second fold line. Where there is both a first fold line of the sheet and a third fold line of the sheet, the substantially planar surface may extend from the first fold line to third fold line. Where there is both a second fold line of the sheet and a third fold line of the sheet, the substantially planar surface may extend from the second fold line to the third fold line.

The support element may comprise a substantially straight portion, when viewed from the upstream end of the hollow tubular element. The substantially straight portion may extend from the first point at the peripheral portion, when viewed from the upstream end of the hollow tubular element. The substantially straight portion may extend to the second point at the peripheral portion, when viewed from the upstream end of the hollow tubular element. The substantially straight portion may extend from the first point at the peripheral portion to the second point at the peripheral portion, when viewed from the upstream end of the hollow tubular element. In particular, where there is a first fold line of the sheet, the substantially straight portion may extend from the first fold line of the sheet, when viewed from the upstream end of the hollow tubular element. Where there is a second fold line of the sheet, the substantially straight portion may extend to the second fold line, when viewed from the upstream end of the hollow tubular element. Where there is both a first fold line and a second fold line of the sheet, the substantially planar surface may extend from the first fold line to the second fold line, when viewed from the upstream end of the hollow tubular element. Where there is both a first fold line of the sheet and a third fold line of the sheet, the substantially straight portion may extend from the first fold line to third fold line, when viewed from the upstream end of the hollow tubular element. Where there is both a second fold line of the sheet and a third fold line of the sheet, the substantially straight portion may extend from the second fold line to the third fold line, when viewed from the upstream end of the hollow tubular element.

Where there is a both a first fold line and a third fold line, the first fold line and the third fold line may define a first side wall of the support element. That is, the first side wall may extend from the first fold line to the third fold line and there are no fold lines therebetween. The first side wall may be substantially straight. The first side wall may be curved.

The first side wall may be wholly enclosed by the peripheral portion of the hollow tubular element and therefore, does not form an outer surface of the hollow tubular element.

Where there is both a second fold line and a third fold line, the second fold line and the third fold line may define a second side wall of the support element. That is, the second side wall may extend from the second fold line to the third fold line and there are no fold lines therebetween. The second side wall may be substantially straight. The second side wall may be curved.

The second side wall may be wholly enclosed by the peripheral portion of the hollow tubular element and therefore, does not form an outer surface of the hollow tubular element.

The first side wall of the support element may form an outer surface of the hollow tubular element. The second side wall of the support element may form an outer surface of the hollow tubular element. For example, the hollow tubular element may comprise a peripheral portion and a support element formed integrally from the same sheet; wherein substantially the entirety of the peripheral portion and substantially the entirety of the support element are formed from a single layer of the sheet (excluding a seam); wherein the support element depends from the peripheral portion along both a first fold line of the sheet and a second fold line of the sheet; wherein the support element comprises a third fold line residing within the hollow inner region of the hollow tubular element, the first fold line and the third fold line defining a substantially straight first side wall of the support element, the second fold line and the third fold line defining a substantially straight second side wall of the support element; and wherein the first side wall and the second side wall from an angle of, for example, 30 degrees about the third fold line. In this example the first side wall forms an outer surface of the hollow tubular element, and the second side wall forms an outer surface of the hollow tubular element.

The outer surface of the hollow tubular element may be formed from the peripheral portion, the first side wall of the support element and the second side wall of the support element.

Where the first side wall is substantially straight and the second side wall is substantially straight, the first side wall and the second side wall may define an angle of about degrees or more therebetween. That is, the angle between the first side wall and the second side wall may be about 5 degrees or more. In other words, the angle about the third fold line may be about 5 degrees or more. Preferably, the angle between the first side wall and the second side wall at the third fold line is about 10 degrees or more, more preferably about 15 degrees or more, even more preferably about 20 degrees or more.

Where the first side wall is substantially straight and the second side wall is substantially straight, the angle between the first side wall and the second side wall may be about 50 degrees or less, preferably the angle between the first side wall and the second side wall at the third fold line is about 45 degrees or less, more preferably about 40 degrees or less, even more preferably about 35 degrees or less.

Where the first side wall is substantially straight and the second side wall is substantially straight, the angle between the first side wall and the second side wall may be between about 5 degrees and about 50 degrees, preferably between about 10 degrees and about 45 degrees, more preferably between about 15 degrees and about 40 degrees, even more preferably between about 20 degrees and about 35 degrees.

A surface of the first side wall and a surface of the second side wall may be in contact with each other. A surface of the first side wall and a surface of the second side wall may be attached to each other by an adhesive. Substantially the entire outer surface of the first side wall and substantially the entire outer surface of the second side wall may be in contact with each other. Substantially the entire outer surface of the first side wall and substantially the entire outer surface of the second side wall may be attached to each other by an adhesive. The use of an adhesive may help to improve the mechanical strength of the hollow tubular element in one or both of the longitudinal direction and the transverse direction. As such, this may help to improve the hollow tubular element's resistance to collapse or deformation and the hollow tubular element's ability to prevent or restrict movement of at least part of the first element, and any components provided therein. Where the first side wall is substantially straight and the second side wall is substantially straight, the angle formed between the first side wall and the second side wall may be approximately zero degrees.

A cross section of the support element may comprise a curved portion. The support element may comprise a curved portion, when viewed from the upstream end of the hollow tubular element. The support element may comprise a substantially s-shaped cross section. The support element may be substantially s-shaped, when viewed from the upstream end of the hollow tubular element. The support element may comprise a substantially omega-shaped cross section. The support element may be substantially omega-shaped, when viewed from the upstream end of the hollow tubular element. The support element may comprise a substantially c-shaped cross section. The support element may be substantially c-shaped, when viewed from the upstream end of the hollow tubular element.

The support element may have a wave profile as viewed from the upstream end of the hollow tubular element. The support element may comprise a plurality of peaks and troughs, when viewed from the upstream end of the hollow tubular element. The support element may be substantially sinusoidal, when viewed from the upstream end of the hollow tubular element. The support element may have a substantially triangular wave profile as viewed form the upstream end of the hollow tubular element. For example, the support element may be substantially w-shaped as viewed from the upstream end of the hollow tubular element.

The hollow tubular element may comprise at least one longitudinal plane of symmetry. The hollow tubular element may be radially symmetric. This may simplify assembling of the aerosol-generating article, since the orientation in which the hollow tubular element is inserted into the aerosol-generating article may be less important. In addition, this may also mean that the hollow tubular element is able to distribute load more evenly to be able to withstand increased forces being applied to it.

Preferably, the cross-sectional area of the hollow tubular element is substantially constant along the entire length of the hollow tubular element. This may be such that the resistance to draw of the aerosol-generating article is also constant along the entire length of the hollow tubular element.

Preferably, the hollow tubular element has a substantially constant cross section along the entire length of the hollow tubular element. That is, the cross section of the hollow tubular element does not change substantially along the entire length of the hollow tubular element. This may simplify manufacturing of the hollow tubular element. Alternatively, the cross section of the hollow tubular element may vary along the length of the hollow tubular element. For example, the support element may have a cross section that varies along the length of the hollow tubular element. For instance, the support element may not extend along the entire length of the hollow tubular element.

The support element may divide the hollow inner region of the hollow tubular element into a plurality of channels. The number of channels may be selected based on a desired nucleation of aerosol particles and a desired resistance to draw of the aerosol-generating article. The support element may divide the cavity of the hollow tubular element into two channels. The support element may divide the cavity of the hollow tubular element into three channels. The support element may divide the cavity of the hollow tubular element into four channels. The support element may divide the cavity of the hollow tubular element into between two channels and four channels. The support element may divide the cavity of the hollow tubular element into at least three channels.

The support element may extend through the radial centre of the hollow tubular element.

The support element may be spaced apart from the radial centre of the hollow tubular element by a distance of about 5 percent or more of the radius of the hollow tubular element, preferably about 10 percent or more of the radius of the hollow tubular element, more preferably about 15 percent or more of the radius of the hollow tubular element.

The support element may be spaced apart from the radial centre of the hollow tubular element by a distance of about 90 percent or less of the radius of the hollow tubular element, preferably about 80 percent or less of the radius of the hollow tubular element from the radial centre of the hollow tubular element, more preferably about 70 percent or less of the radius of the hollow tubular element from the radial centre of the hollow tubular element.

The support element may be spaced apart from the radial centre of the hollow tubular element by a distance of between about 5 percent and about 90 percent of the radius of the hollow tubular element, preferably between about 10 percent and about 80 percent of the radius of the hollow tubular element, more preferably between about 15 percent and about 70 percent of the radius of the hollow tubular element.

The support element may be spaced apart from the radial centre of the hollow tubular element by a distance of about 0.2 millimetres or more, preferably about 0.5 millimetres or more, more preferably about 1 millimetre or more from the radial centre of the hollow tubular element.

The support element may be spaced apart from the radial centre of the hollow tubular element by a distance of about 3 millimetres or less, preferably about 2.5 millimetres or less, more preferably about 2 millimetres or less, or about 1 millimetre or less.

The support element may be spaced apart from the radial centre of the hollow tubular element by a distance of between about 0.2 millimetres and about 3 millimetres, preferably between about 0.5 millimetres and about 2.5 millimetres, more preferably between about 1 millimetre and about 2 millimetres, or between about 0.5 millimetres and about 1 millimetre. Where the support element comprises a tip, the support element may have a depth of about 0.6 millimetres or more, preferably about 1 millimetre or more, more preferably about 1.5 millimetres or more.

Where the support element comprises a tip, the support element may have a depth of about 3 millimetres or less, preferably about 2.7 millimetres or less, more preferably about 2.5 millimetres or less.

Where the support element comprises a tip, the support element may have a depth of between about 0.6 millimetres and about 3 millimetres, preferably between about 1 millimetre and about 2.7 millimetres, more preferably between about 1.5 millimetres and about 2.5 millimetres. Where the support element comprises a tip, the support element may have a depth of between about 2 millimetres and about 3 millimetres.

Where the support element comprises a tip, the support element may have a depth of about 2 millimetres. Where the support element comprises a tip, the support element may have a depth equal to about the inner radius of the hollow tubular element.

As used herein, the term "depth" denotes the distance between the first point at the peripheral portion and the tip of the support element.

The support element may be the only support element of the hollow tubular element. That is, the hollow tubular element may comprise a single support element. Alternatively, the support element may be a first support element and the hollow tubular element may comprise one or more additional support elements. Each of the one or more additional support elements may be formed from a sheet. The one or more additional support elements may be formed from separate sheets. Preferably, the one or more additional support elements are formed from the same sheet as the first support element. Each of the one or more additional support elements may extend from a respective first point at the peripheral portion across the hollow inner region to a respective second point at the peripheral portion.

The one or more additional support elements may depend from the peripheral portion along a respective first fold line of the sheet, wherein the respective first fold line resides at the respective first point at the peripheral portion. The one or more additional support elements may depend from the peripheral portion along a respective second fold line of the sheet, wherein the respective second fold line resides at the respective second point at the peripheral portion.

The hollow tubular element may comprise between two and six support elements. Preferably, the hollow tubular element comprises three support elements. Three support elements may help to improve the hollow tubular element's resistance to collapse or deformation and the hollow tubular element's ability to prevent or restrict movement of at least part of the aerosol-forming substrate.

Each of the support elements may be identical to one another. This may simplify manufacturing of the hollow tubular element. Alternatively, one of the support elements may be different to another support element. For example, the first support element may be larger in size than the second support element.

Each of the support elements may have any combination of the features described above in respect of the support element, that is, the first support element.

Each of the support elements may be about equally spaced around the peripheral portion of the hollow tubular element. This means that the separation between the first point at the peripheral portion from which one of the support element extends and the first point at the peripheral portion from which the next support element extends is about the same around the peripheral portion of the hollow tubular element.

Where the support elements are identical to one another and are equally spaced around the peripheral portion of the hollow tubular element, the hollow tubular element may comprise radial symmetry. This may simplify assembling of the aerosol-generating article, since the orientation in which the hollow tubular element is inserted into the aerosol-generating article may be less important. In addition, this may also mean that the hollow tubular element is able to distribute load more evenly to be able to withstand increased forces being applied to it.

The hollow tubular element may have a length of about 4 millimetres or more, preferably about 6 millimetres or more, more preferably about 8 millimetres or more.

The hollow tubular element may have a length of about 40 millimetres or less, preferably about 30 millimetres or less, more preferably about 20 millimetres or less.

The hollow tubular element may have a length of between about 4 millimetres and about 40 millimetres, preferably between about 6 millimetres and about 30 millimetres, more preferably between about 8 millimetres and about 20 millimetres.

The hollow tubular element may have a length of about 8 millimetres. The hollow tubular element may have a length of about 18 millimetres.

The hollow tubular element preferably has an outer diameter that is approximately equal to the outer diameter of the aerosol-generating article. Where the first element is formed as a rod, the hollow tubular element preferably has an outer diameter that is approximately equal to the outer diameter of the first element.

The hollow tubular element may have an outer diameter of about 5 millimetres or more, preferably about 6 millimetres or more, more preferably about 7 millimetres or more.

The hollow tubular element may have an outer diameter of about 12 millimetres or less, preferably about 10 millimetres or less, more preferably about 8 millimetres or less.

The hollow tubular element may have an outer diameter of between about 5 millimetres and about 12 millimetres, preferably between about 6 millimetres and about 10 millimetres, more preferably, between about 7 millimetres and about 8 millimetres.

The hollow tubular element may have an outer diameter of about 7.2 millimetres.

The hollow tubular element may have an inner diameter of about 4.5 millimetres or more, preferably about 5.5 millimetres or more, more preferably about 6.5 millimetres or more.

The hollow tubular element may have an inner diameter of about 11.5 millimetres or less, preferably about 9.5 millimetres or less, more preferably about 7.5 millimetres or less.

The hollow tubular element may have an inner diameter of between about 4.5 millimetres and about 11.5 millimetres, preferably between about 5.5 millimetres and about 9.5 millimetres, more preferably between about 6.5 millimetres and about 7.5 millimetres.

The hollow tubular element may have a total internal surface area of about 25 millimetres squared per millimetre length or more, preferably about 28 millimetres squared per millimetre length or more, more preferably about 30 millimetres squared per millimetre length or more, or about 35 millimetres squared per millimetre length or more.

The hollow tubular element may have a total internal surface area of about 70 millimetres squared per millimetre length or less, preferably about 60 millimetres squared per millimetre length or less, more preferably about 50 millimetres squared per millimetre length or less, or about 40 millimetres squared per millimetre length or less.

The hollow tubular element may have a total internal surface area of between about millimetres squared per millimetre length and about 70 millimetres squared per millimetre length, preferably between about 28 millimetres squared per millimetre length and about 60 millimetres squared per millimetre length, more preferably between about 30 millimetres squared per millimetre length and about 50 millimetres squared per millimetre length, or between about 30 millimetres squared per millimetre length and about 40 millimetres squared per millimetre length. The hollow tubular element may have a total internal surface area of between about 35 millimetres squared per millimetre length and about 70 millimetres squared per millimetre length, preferably between about 40 millimetres squared per millimetre length and about 70 millimetres squared per millimetre length, more preferably between about 50 millimetres squared per millimetre length and about 70 millimetres squared per millimetre length, or between about 60 millimetres squared per millimetre length and about 70 millimetres squared per millimetre length.

Preferably, the hollow tubular element provides an unrestricted flow channel. This means that the hollow tubular segment preferably provides a negligible level of resistance to draw (RTD). The term "negligible level of RTD" is used to describe an RTD of less than 1 mm $H_2O$ per 10 millimetres of length of the hollow tubular element, preferably less than 0.4 mm $H_2O$ per 10 millimetres of length of the hollow tubular element, more preferably less than 0.1 mm $H_2O$ per 10 millimetres of length of the hollow tubular element. The flow channel should therefore be free from any components that would obstruct the flow of air in a longitudinal direction. Preferably, the flow channel is substantially empty.

Unless otherwise specified, the resistance to draw (RTD) of a component or the aerosol-generating article is measured in accordance with ISO 6565-2015. The RTD refers the pressure required to force air through the full length of a component. The terms "pressure drop" or "draw resistance" of a component or article may also refer to the "resistance to draw". Such terms generally refer to the measurements in accordance with ISO 6565-2015 are normally carried out at under test at a volumetric flow rate of about 17.5 millilitres per second at the output or downstream end of the measured component at a temperature of about 22 degrees Celsius, a pressure of about 101 kPa (about 760 Torr) and a relative humidity of about 60%.

The hollow tubular element may have a porosity of about 80 percent or more in the longitudinal direction, preferably about 90 percent or more in the longitudinal direction, more preferably about 95 percent or more in the longitudinal direction.

The hollow tubular element may have a porosity of between about 80 percent and about 99 percent in the longitudinal direction, or between about 85 percent and about 95 percent in the longitudinal direction, or between about 90 percent and about 95 percent in the longitudinal direction. Preferably, the hollow tubular element has a porosity of between about percent and about 99.9 percent in the longitudinal direction, or between about 96 percent and about 99.5 percent in the longitudinal direction, or between about 97 percent and about 99 percent in the longitudinal direction, or about 98 percent in the longitudinal direction.

As used herein, the porosity of the hollow tubular element in the longitudinal direction is defined by the ratio of the cross-sectional area of material forming the hollow tubular element and the internal cross-sectional area of the aerosol-generating article at the position of the hollow tubular element.

The porosity in the longitudinal direction of the hollow tubular element may advantageously be selected in order to provide a desirable overall resistance to draw of the aerosol-generating article.

The porosity in the longitudinal direction of the hollow tubular element may be substantially constant along the entire length of the hollow tubular element. For example, the cross-sectional area of material forming the hollow tubular element may be substantially constant along the entire length of the hollow tubular element and the aerosol-generating article may also have a substantially constant internal cross-sectional area along the entire length of the hollow tubular element. The hollow tubular element may have a substantially constant cross section along the entire length of the hollow tubular element such that the cross-sectional area of material forming the hollow tubular element is substantially constant along the entire length of the hollow tubular element. The hollow tubular element may also have a cross section that varies along the length of the hollow tubular element and a substantially constant cross-sectional area of material forming the hollow tubular element along the entire length of the hollow tubular element.

The porosity in the longitudinal direction of the hollow tubular element may vary along the length of the hollow tubular element. For example, this may be the case where the hollow tubular element does not have a constant cross section along the entire length of the hollow tubular element such that the cross-sectional area of material forming the hollow tubular element varies along the length of the hollow tubular element.

The sheet forming one or both of the support element and the peripheral portion may be formed from paper, any other paper-based material, any other cellulose-based material, a bioplastic-based material, or a metal. For example, the sheet may be formed from one or more of paper, paperboard, cardboard, reconstituted tobacco paper, cellophane and aluminium.

Preferably the sheet is formed from a biodegradable material.

Most preferably, the sheet is formed from a paper-based material, such as paper, paperboard or cardboard. The paper-based material may be bleached or unbleached. Paper-based materials may be one or more of light, cheap and biodegradable. Where one or both of the support element and the peripheral portion is formed from a paper sheet, the hollow tubular element is able to prevent or restrict movement of least part of the first element and any components provided therein, whilst exhibiting sufficient mechanical strength and stiffness to withstand significant deformation during at least one of handling, transport and use of the aerosol-generating article, for example during interaction of the aerosol-generating article with an aerosol-generating device. The interaction may involve insertion of the aerosol-generating article into the aerosol-generating device. The material properties of a paper sheet may be such that individual hollow tubular elements comprising a peripheral portion and a support element, wherein one or both of the peripheral portion and the support element is formed from a paper sheet, may be cut from a continuous rod of hollow tubular element. This may simplify manufacturing of the hollow tubular element.

Aluminium has a very high ignition temperature. As such, a hollow tubular element comprising a support element and a peripheral portion, wherein one or both of the peripheral portion and the support element is formed from an aluminium sheet, may help to avoid ignition of the hollow tubular element at temperatures reached by the aerosol-generating article during use.

The sheet forming one or both of the peripheral portion and the support element may have a basis weight of about 15 grams per square metre or more, preferably about 25 grams per square metre or more, more preferably about 35 grams per square metre or more, or about grams per square metre or more. A sheet with such basis weight may avoid one or both of crack formation and breakage during one or both of bending and folding of the sheet. As such, the sheet may retain its structural integrity when bent or folded to form the support element. This may improve the hollow tubular element's resistance to collapse or deformation and the hollow tubular element's ability to prevent or restrict movement of one or both of at least part of the aerosol-forming substrate and at least part of the susceptor element.

The sheet forming one or both of the peripheral portion and the support element may have a basis weight of about 150 grams per square metre or less, preferably about 130 grams per square metre or less, more preferably about 110 grams per square metre or less, or about grams per square metre or less, or about 50 grams per square metre or less. Providing a sheet with such basis weight may advantageously ensure that the hollow tubular element has a desired porosity in the longitudinal direction. This may be such that the hollow tubular element has a desired resistance to draw. In addition, providing a sheet with such basis weight may advantageously make the hollow tubular element easier to manufacture, for example, by making the sheet easier to at least one of roll, bend and fold the sheet.

The sheet may have a basis weight of between about 15 grams per square metre and about 150 grams per square metre, between about 20 grams per square metre and about 130 grams per square metre, between about 60 grams per square metre and about 100 grams per square metre, between about 70 grams per square metre and about 80 grams per square metre.

Preferably, the sheet has a basis weight of between about 45 grams per square metre and about 110 grams per square metre. The sheet may have a basis weight of about 45 grams per square metre. The sheet may have a basis weight of about 60 grams per square metre. Preferably, the sheet has a basis weight of about 78 grams per square metre. Preferably, the sheet has a basis weight of 110 grams per square metre.

The sheet forming one or both of the peripheral portion and the support element may have a thickness of about 15 micrometres or more, about 30 micrometres or more, about 45 micrometres or more, about 100 micrometres or more. A sheet with such thickness may avoid one or both of crack formation and breakage during one or both of bending and folding of the sheet. As such, the sheet may retain its structural integrity when bent or folded to form the support element. This may improve the hollow tubular element's resistance to collapse or deformation and the hollow tubular element's ability to prevent or restrict movement of one or both of at least part of the aerosol-forming substrate and at least part of the susceptor element.

The sheet forming one or both of the peripheral portion and the support element may have a thickness of about 150 micrometres or less, preferably about 140 micrometres or less, more preferably about 130 micrometres or less. Providing a sheet with such thickness may advantageously ensure that the hollow tubular element has a desired porosity in the longitudinal direction. This may be such that the hollow tubular element has a desired resistance to draw. In addition, providing a sheet with such basis weight may advantageously make the hollow tubular element easier to manufacture, for example, by making the sheet easier to at least one of roll, bend and fold the sheet.

The sheet may have a thickness of between about 15 micrometres and about 150 micrometres, preferably between about 30 micrometres and about 140 micrometres, more preferably between about 100 micrometres and about 130 micrometres.

Where the sheet forming one or both of the peripheral portion and the support element is an aluminium sheet, the sheet may have a thickness of between about 10 micrometres and about 20 micrometres. An aluminium sheet with such thickness may advantageously make the hollow tubular element easier to manufacture, for example, by making the sheet easier to at least one of roll, bend and fold the sheet. In addition, an aluminium sheet with such thickness may provide the hollow tubular element with sufficient strength and stiffness to prevent or resist movement of one or both of at least part of the first element and any components provided therein, whilst preventing deformation of the hollow tubular element. Furthermore, an aluminium sheet with such basis weight may advantageously ensure that the hollow tubular element has a desired porosity in the longitudinal direction.

Substantially the entirety of the support element may be formed from a single layer of the sheet which forms the support element. In this case, substantially the entirety of the support element may have a thickness about the same as the thickness of the sheet. The support element may comprise a seam, the seam may be formed from overlapped layers of the sheet. The overlapped layers of the sheet forming the seam may be attached to each other by an adhesive.

The peripheral portion of the hollow tubular element may be formed from a sheet. The peripheral portion may be formed from a single layer of the sheet. The peripheral portion may be formed from a plurality of overlapping layers of the sheet, such as a plurality of parallel wound sheet layers or a plurality of spirally wound sheet layers. Where the peripheral portion comprises a seam, the seam may be formed from overlapped layers of the sheet. For example, the majority of the peripheral portion may be formed from a single layer of the sheet, and the seam may be formed from two overlapped layers of the sheet.

Where the peripheral portion is formed from a single layer of a sheet, the peripheral portion has a thickness about the same as the thickness of the sheet.

The peripheral portion may be formed from multiple sheets. For example, the peripheral portion may be formed from both a sheet which forms the support element, and an additional sheet.

The peripheral portion may be formed from a total of four layers or less of one or more of the sheets that form the peripheral portion. The peripheral portion may be formed from a combined total of four layers or less of the sheets that form the peripheral portion.

A section of the peripheral portion may be formed from a different number of layers of a sheet from a further section of the peripheral portion. For example, a section of the peripheral portion may be formed from one layer of a sheet, and an additional section of the peripheral portion may be formed from two layers of the sheet. As another example, a section of the peripheral portion may be formed from two layers of a sheet, an additional section of the peripheral portion may be formed from three layers of the sheet, and a further section of the peripheral portion may be formed from four layers of the sheet.

The peripheral portion may have a thickness of about 15 micrometres or more, about 45 micrometres or more, about 100 micrometres or more. Providing a peripheral portion with such thickness may provide the hollow tubular element with sufficient strength and stiffness to prevent or resist movement of one or both of the first element and the susceptor element, whilst preventing deformation of the hollow tubular element.

The peripheral portion may have a thickness of about 600 micrometres or less, about 500 micrometres or less, about 400 micrometres or less. Providing a peripheral portion with such thickness may advantageously ensure that the hollow tubular element has a desired porosity in the longitudinal direction. This may be such that the hollow tubular element has a desired resistance to draw. In addition, providing a peripheral portion with such thickness may mean that individual hollow tubular elements may be easily cut from a continuous rod of hollow tubular element. This may simplify manufacturing of the hollow tubular element.

The peripheral portion may have a thickness of between about 15 micrometres and about 600 micrometres, between about 50 micrometres and about 500 micrometres, between about 100 micrometres and about 400 micrometres. Preferably, the peripheral portion has a thickness of between about 100 micrometres and about 130 micrometres.

A hollow tubular element with an low overall weight has the advantage that it may be assembled in an aerosol-generating article using high speed machines and processes. In particular, the inventors of the present invention have found that a hollow tubular element with an overall weight of about 150 milligrams or less may advantageously be assembled in an aerosol-generating article using existing high speed aerosol-generating article assembly machines.

The hollow tubular element may have an overall weight of about 150 milligrams or less, preferably about 100 milligrams or less, more preferably about 70 milligrams or less.

The hollow tubular element may have an overall weight of between about 15 milligrams and about 150 milligrams, preferably between about 20 milligrams and about 100 milligrams, about 25 milligrams and about 70 milligrams.

The hollow tubular element may have an overall weight of about 34 milligrams. The hollow tubular element may have an overall weight of about 76 milligrams.

The hollow tubular element has an average weight of about 10 milligrams per millimetre length of the hollow tubular element or less, preferably about 8 milligrams per millimetre length of the hollow tubular element or less, more preferably about 6 milligrams per millimetre length of the hollow tubular element or less. Providing a hollow tubular element with such average weight may advantageously enable the hollow tubular element to be assembled into an aerosol-generating article using existing high speed aerosol-generating article assembly machines.

The hollow tubular element may have an average weight of between about 1 and about 10 milligrams per millimetre length of the hollow tubular element, preferably between about 1.5 and about 8 milligrams per millimetre length of the hollow tubular element, more preferably between about 2 and about 6 milligrams per millimetre length of the hollow tubular element.

The hollow tubular element may have an average weight of about 4.25 milligrams per millimetre length of the hollow tubular element.

As used herein, the average weight of the hollow tubular element is measured by dividing the total weight of the hollow tubular element by the length of the hollow tubular element.

The hollow tubular element may comprise a flame retardant portion comprising a flame retardant composition. For example, one or both of the support element and the peripheral portion may comprise a flame retardant portion. The sheet forming the support element may comprise a flame retardant portion. Where the peripheral portion is formed from a sheet, the sheet forming the peripheral portion may comprise a flame retardant portion. The flame retardant portion may prevent one or both of scorching and charring of the hollow tubular element during use of an aerosol-generating article comprising the hollow tubular element. This is because by providing the hollow tubular element with one or more flame retardant compounds it is possible to substantially prevent any heat transferred to the hollow tubular element from causing pyrolysis or combustion of the hollow tubular element.

The flame retardant portion may avoid the need for an additional layer of metallic foil or other heat-shielding material to be included in one or both of the hollow tubular element and the aerosol-generating article. This may simplify the manufacturing process and may therefore reduce manufacturing costs. It may also make it easier to dispose of the aerosol-generating article, since there may not be any need to separate and recover a valuable recyclable material, such as for example aluminium foil, when a used aerosol-generating article is discarded.

As used herein, the term "flame retardant composition" denotes a composition comprising one or more flame retardant compounds.

As used herein, the term "flame retardant compounds" describes chemical compounds that, when added to or otherwise incorporated into a substrate, such as paper or plastic compounds, provide the substrate with varying degrees of flammability protection. In practice, flame retardant compounds may be activated by the presence of an ignition source and are adapted to prevent or slow the further development of ignition by a variety of different physical and chemical mechanisms.

The flame retardant composition may comprise a polymer and a mixed salt based on at least one mono, di- and/or tri-carboxylic acid, at least one polyphosphoric, pyrophosphoric and/or phosphoric acid, and a hydroxide or a salt of an alkali or an alkaline earth metal, where the at least one mono, di- and/or tri-carboxylic acid and the hydroxide or salt form a carboxylate and the at least one polyphosphoric, pyrophosphoric and/or phosphoric acid and the hydroxide or salt form a phosphate.

The flame retardant composition may comprise cellulose modified with at least one $C_{10}$ or higher fatty acid, tall oil fatty acid (TOFA), phosphorylated linseed oil, phosphorylated downstream corn oil. Preferably, the at least one $C_{10}$ or higher fatty acid is selected from the group consisting of capric acid, myristic acid, palmitic acid, and combinations thereof.

Part of the hollow tubular element may be circumscribed by a wrapper. The entirety of the hollow tubular element may be circumscribed by a wrapper. The wrapper may be a paper wrapper.

Preferably, the hollow tubular element is connected to one or more of the adjacent components of the aerosol-generating article by means of a wrapper. The wrapper may be a paper wrapper.

The aerosol-generating article may comprise a susceptor element. The susceptor element may be arranged within the first element. The susceptor element may be arranged within the aerosol-forming substrate. The susceptor element may be arranged around the aerosol-forming substrate.

Where the aerosol-generating article comprises a susceptor element, the support element may act to provide a support barrier for at least part of the susceptor element. This may help to prevent or restrict movement of at least part of the susceptor element during at least one of handling, use and transport of the aerosol-generating article. Movement of part of the susceptor element may have an even larger negative impact on the performance of the aerosol-generating article than movement of part of the aerosol-forming substrate. This is because movement of part of the susceptor element may affect one or both of the ability of the susceptor element to be inductively heated and the ability of the susceptor element to heat the aerosol-forming substrate during use of the aerosol-generating article. Therefore, preventing or restricting movement of at least part of the susceptor element may have a significant effect on the experience for a user. Accordingly, preventing or restricting movement of at least part of the susceptor element may lead to a further consistent experience for a user.

Where the aerosol-generating article comprises a susceptor element, preventing or restricting movement of one or both of at least part of the aerosol-forming substrate and at least part of the susceptor element may help to increase the consistency of interaction between the aerosol-forming substrate and the susceptor element. This may enable the susceptor element to heat the aerosol-forming substrate in a more consistent manner when the aerosol-generating article is being used, which may also lead to a more consistent experience for a user.

As used herein, the term "susceptor element" refers to a material that can convert electromagnetic energy into heat. When located within a fluctuating electromagnetic field, eddy currents induced in the susceptor element cause heating of the susceptor element.

Where the aerosol-generating article comprises a susceptor element, the susceptor element may be configured to be in thermal contact with the aerosol-forming substrate. As such, the aerosol-forming substrate may be heated by the susceptor element during use of the aerosol-generating article.

The susceptor element may be an elongate susceptor element. The susceptor element may extend longitudinally within the aerosol-forming substrate.

When used for describing the susceptor element, the term "elongate" means that the susceptor element has a length dimension that is greater than its width dimension or its thickness dimension, for example greater than twice its width dimension or its thickness dimension.

The susceptor element may be arranged substantially longitudinally within the first element. This means that the length dimension of the elongate susceptor element may be arranged to be approximately parallel to the longitudinal direction of the first element, for example, within plus or minus 10 degrees of parallel to the longitudinal direction of the first element. Preferably, the elongate susceptor element is positioned in a radially central position within the first element, and extends along the longitudinal axis of the first element.

Preferably, the susceptor element extends all the way to a downstream end of the first element. The susceptor element may extend all the way to an upstream end of the first element. Preferably, the susceptor element has substantially the same length as the first element, and extends from the upstream end of the first element to the downstream end of the first element.

The susceptor element is preferably in the form of a pin, rod, strip or blade.

The susceptor element preferably has a length from about 5 millimetres to about 15 millimetres, for example from about 6 millimetres to about 12 millimetres, or from about 8 millimetres to about 10 millimetres.

The susceptor element preferably has a width from about 1 millimetre to about 5 millimetres.

The susceptor element may generally have a thickness from about 0.01 millimetres to about 2 millimetres, for example from about 0.5 millimetres to about 2 millimetres. The susceptor element may have a thickness from about 10 micrometres to about 500 micrometres, more preferably from about 10 micrometres to about 100 micrometres.

If the susceptor element has a constant cross-section, for example a circular cross-section, it has a preferable width or diameter from about 1 millimetre to about 5 millimetres.

If the susceptor element has the form of a strip or blade, the strip or blade preferably has a rectangular shape having a width of preferably from about 2 millimetres to about 8 millimetres, more preferably from about 3 millimetres to about 5 millimetres. By way of example, a susceptor element in the form of a strip of blade may have a width of about 4 millimetres.

If the susceptor element has the form of a strip or blade, the strip or blade preferably has a rectangular shape and a thickness from about 0.03 millimetres to about 0.15 millimetres, more preferably from about 0.05 millimetres to about 0.09 millimetres. By way of example, a susceptor element in the form of a strip of blade may have a thickness of about 0.06 millimetres or 0.07 millimetres.

Preferably, the elongate susceptor element is in the form of a strip or blade, and has a rectangular shape and a thickness from about 55 micrometres to about 65 micrometres.

Preferably, the elongate susceptor element has a length which is the same or shorter than the length of the aerosol-forming substrate. Preferably, the elongate susceptor element has a same length as the aerosol-forming substrate.

The susceptor element may be formed from any material that may be inductively heated to a temperature sufficient to generate an aerosol from the aerosol-forming substrate. Preferred susceptor elements comprise a metal or carbon.

A preferred susceptor element may comprise or consist of a ferromagnetic material, for example a ferromagnetic alloy, ferritic iron, or a ferromagnetic steel or stainless steel. A suitable susceptor element may be, or comprise, aluminium. Preferred susceptor elements may be formed from 400 series stainless steels, for example grade 410, or grade 420, or grade 430 stainless steel. Different materials will dissipate different amounts of energy when positioned within electromagnetic fields having similar values of frequency and field strength.

Thus, parameters of the susceptor element such as material type, length, width, and thickness may all be altered to provide a desired power dissipation within a known electromagnetic field. Preferred susceptor elements may be heated to a temperature in excess of 250 degrees Celsius.

The susceptor element is arranged in thermal contact with the aerosol-forming substrate. Thus, when the susceptor element heats up the aerosol-forming substrate is heated up and an aerosol is formed. Preferably, the susceptor element is arranged in direct physical contact with the aerosol-forming substrate, for example within the aerosol-forming substrate.

The susceptor element may be a multi-material susceptor element and may comprise a first susceptor element material and a second susceptor element material. The first susceptor element material may be disposed in intimate physical contact with the second susceptor element material.

The hollow tubular element may comprise an adhesive.

For example, where the peripheral portion comprises a tube, the sheet forming the support element may be attached to the tube by an adhesive at points where the sheet is in contact with the tube. As another example, a point at the peripheral portion may be attached to another point at the peripheral portion by an adhesive. For instance, the first point at the peripheral portion may be attached to the second point at the peripheral portion by an adhesive As another instance, where the sheet that forms the support element also forms part of the peripheral portion, the portion of the sheet that forms part of the peripheral portion may be attached to the remainder of the peripheral portion by an adhesive. As a further example, where the support element is in contact with the peripheral portion, the support element may be attached to the peripheral portion at a point of contact by an adhesive. For instance, where the support element comprises an end of the sheet, the end of the sheet may be attached to the peripheral portion by an adhesive. As an additional example, a point at the support element may be attached to another point at the support element. For instance, where the support element comprises a first side wall and a second side wall, the first side wall may be attached to the second side wall by an adhesive. In addition, where the hollow tubular element comprises a seam formed from overlapped layers of a sheet, the overlapped layers of the sheet may be attached to each other by an adhesive to form the seam.

The adhesive may comprise at least one of PVA, PVOH and hot melt glue.

The adhesive may comprise a binder. Suitable binders include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder comprises guar gum.

The hollow tubular element may be in longitudinal alignment with the first element. In particular, the hollow tubular element may be in longitudinal alignment with the aerosol-forming substrate. Where the aerosol-generating article comprises a susceptor element, the hollow tubular element may be in longitudinal alignment with the susceptor element.

The hollow tubular element may be disposed immediately downstream of the first element. This means that there are no other elements of the aerosol-generating article disposed between the hollow tubular element and the first element. This may help to improve the hollow tubular element's ability to prevent or restrict movement of at least part of the first element and any components provided therein.

The hollow tubular element may be in contact with the first element. For example, the upstream end of the hollow tubular element may be in contact with the downstream end of the first element. That is, the upstream end of the hollow tubular element may abut the downstream end of the first element. In particular, the upstream end of the hollow tubular element may be in contact with the downstream end of the aerosol-forming substrate. That is, the upstream end of the hollow tubular element may abut the downstream end of the aerosol-forming substrate.

The hollow tubular element may be disposed immediately downstream of the first element, but not in contact with the first element, because a gap of empty space separates the hollow tubular element from the first element in the longitudinal direction of the aerosol-generating article. For example, the hollow tubular element may be disposed immediately downstream of the aerosol-forming substrate, but not in contact with the aerosol-forming substrate. The gap may be about 2 millimetres or less, preferably 1 millimetre or less.

The first element may be referred to as an aerosol-generating element.

The aerosol-forming substrate may be referred to as an aerosol-generating substrate.

The aerosol-forming substrate may substantially define the structure and dimensions of the first element. The aerosol-forming substrate may be a solid aerosol-forming substrate. The aerosol-forming substrate may be in the form of a rod.

Preferably, the aerosol-forming substrate comprises homogenised plant material, preferably a homogenised tobacco material.

As used herein, the term "homogenised plant material" encompasses any plant material formed by the agglomeration of particles of plant. For example, sheets or webs of homogenised tobacco material for the aerosol-forming substrates of the present invention may be formed by agglomerating particles of tobacco material obtained by pulverising, grinding or comminuting plant material and optionally one or more of tobacco leaf lamina and tobacco leaf stems. The homogenised plant material may be produced by casting, extrusion, paper making processes or other any other suitable processes known in the art.

The homogenised plant material may be provided in any suitable form. For example, the homogenised plant material may be in the form of one or more sheets. The homogenised plant material may be in the form of a plurality of pellets or granules. The homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

Preferably, the aerosol-forming substrate is in the form of one or more sheets of homogenised plant material. The one or more sheets of homogenised plant material may be produced by a casting process. The one or more sheets of homogenised plant material may be produced by a paper-making process. The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-forming substrate. For example, if the aerosol-forming substrate is formed from two individual sheets, then the combined thickness is the sum of the thickness of the two individual sheets or the measured thickness of the two sheets where the two sheets are stacked in the aerosol-forming substrate.

The one or more sheets as described herein may each individually have a grammage of between about 100 $g/m^2$ and about 300 $g/m^2$.

The one or more sheets as described herein may each individually have a density of from about 0.3 $g/cm^3$ to about 1.3 $g/cm^3$, and preferably from about 0.7 $g/cm^3$ to about 1.0 $g/cm^3$.

Where the aerosol-forming substrate comprises one or more sheets of homogenised plant material, the sheets are preferably in the form of one or more gathered sheets. As used herein, the term "gathered" denotes that the sheet of homogenised plant material is convoluted, folded, or otherwise compressed or constricted substantially transversely to the cylindrical axis of a plug or a rod.

The one or more sheets of homogenised plant material may be gathered transversely relative to the longitudinal axis thereof and circumscribed with a wrapper to form a continuous rod or a plug.

The one or more sheets of homogenised plant material may advantageously be crimped or similarly treated. As used herein, the term "crimped" denotes a sheet having a plurality of substantially parallel ridges or corrugations. Alternatively or in addition to being crimped, the one or more sheets of homogenised plant material may be embossed, debossed, perforated or otherwise deformed to provide texture on one or both sides of the sheet.

Preferably, each sheet of homogenised plant material may be crimped such that it has a plurality of ridges or corrugations substantially parallel to the cylindrical axis of the plug. This treatment advantageously facilitates gathering of the crimped sheet of homogenised plant material to form the plug. Preferably, the one or more sheets of homogenised plant material may be gathered. It will be appreciated that crimped sheets of homogenised plant material may alternatively or in addition have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

The one or more sheets of homogenised plant material may be cut into strands as referred to above. The aerosol-forming substrate may comprise a plurality of strands of the homogenised plant material. The strands may be used to form a plug. The plurality of strands preferably extend substantially longitudinally along the length of the aerosol-forming substrate, aligned with the longitudinal axis. Preferably, the plurality of strands are therefore aligned substantially parallel to each other.

The homogenised plant material may comprise up to about 95 percent by weight of plant particles, on a dry weight basis. Preferably, the homogenised plant material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised plant material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

The homogenised plant material may be a homogenised tobacco material comprising tobacco particles. Sheets of homogenised tobacco material for use in such embodiments may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

The term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. Preferably, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, and other speciality tobaccos.

The tobacco particles may have a nicotine content of at least about 2.5 percent by weight, based on dry weight. More preferably, the tobacco particles may have a nicotine content of at least about 3 percent, even more preferably at least about 3.2 percent, even more preferably at least about 3.5 percent, most preferably at least about 4 percent by weight, based on dry weight.

The homogenised plant material may comprise tobacco particles in combination with non-tobacco plant flavour particles.

The weight ratio of the non-tobacco plant flavour particles and the tobacco particles in the particulate plant material forming the homogenised plant material may vary depending on the desired flavour characteristics and composition of the aerosol produced from the aerosol-forming substrate during use.

The homogenised plant material may comprise *cannabis* particles. The term "*cannabis* particles" refers to particles of a *cannabis* plant, such as the species *Cannabis sativa, Cannabis indica*, and *Cannabis ruderalis*.

The homogenised plant material preferably comprises no more than 95 percent by weight of the particulate plant material, on a dry weight basis. The particulate plant material is therefore typically combined with one or more other components to form the homogenised plant material.

The homogenised plant material may further comprise a binder to alter the mechanical properties of the particulate plant material, wherein the binder is included in the homogenised plant material during manufacturing as described herein. The binder being an exogenous binder. Suitable exogenous binders would be known to the skilled person and include but are not limited to: gums such as, for example, guar gum, xanthan gum, arabic gum and locust bean gum;

cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder comprises guar gum.

The binder may be present in an amount of from about 1 percent to about 10 percent by weight, based on the dry weight of the homogenised plant material, preferably in an amount of from about 2 percent to about 5 percent by weight, based on the dry weight of the homogenised plant material.

The homogenised plant material may further comprise one or more lipids to facilitate the diffusivity of volatile components (for example, aerosol formers, gingerols and nicotine), wherein the lipid is included in the homogenised plant material during manufacturing as described herein. Suitable lipids for inclusion in the homogenised plant material include, but are not limited to: medium-chain triglycerides, cocoa butter, palm oil, palm kernel oil, mango oil, shea butter, soybean oil, cottonseed oil, coconut oil, hydrogenated coconut oil, candellila wax, carnauba wax, shellac, sunflower wax, sunflower oil, rice bran, and Revel A; and combinations thereof.

The homogenised plant material may further comprise a pH modifier.

The homogenised plant material may further comprise fibres to alter the mechanical properties of the homogenised plant material, wherein the fibres are included in the homogenised plant material during manufacturing as described herein. Suitable exogenous fibres for inclusion in the homogenised plant material are known in the art and include fibres formed from non-tobacco material and non-ginger material, including but not limited to: cellulose fibres; soft-wood fibres; hard-wood fibres; jute fibres and combinations thereof. Exogenous fibres derived from tobacco and/or ginger may also be added. Any fibres added to the homogenised plant material are not considered to form part of the "particulate plant material" as defined above.

Preferably, the fibres are present in an amount of about 2 percent to about 15 percent by weight, most preferably at about 4 percent by weight, based on the dry weight of the substrate.

The aerosol-forming substrate may comprise one or more aerosol formers. Preferably, the aerosol-forming substrate comprises homogenised plant material comprising the one or more aerosol formers. Upon volatilisation, an aerosol former may convey other vaporised compounds released from the aerosol-forming substrate upon heating, such as nicotine and flavourants, in an aerosol. Suitable aerosol formers for inclusion in the aerosol-forming substrate are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-forming substrate may have an aerosol former content of between about percent and about 30 percent by weight on a dry weight basis, such as between about 10 percent and about 25 percent by weight on a dry weight basis, or between about 15 percent and about 20 percent by weight on a dry weight basis.

For example, if the substrate is intended for use in an aerosol-generating article for an electrically-operated aerosol-generating system having a heating element, it may preferably include an aerosol former content of between about 5 percent to about 30 percent by weight on a dry weight basis. If the substrate is intended for use in an aerosol-generating article for an electrically-operated aerosol-generating system having a heating element, the aerosol former is preferably glycerol.

The aerosol-forming substrate may have an aerosol former content of about 1 percent to about 5 percent by weight on a dry weight basis. For example, if the substrate is intended for use in an aerosol-generating article in which aerosol former is kept in a reservoir separate from the substrate, the substrate may have an aerosol former content of greater than 1 percent and less than about 5 percent. In such embodiments, the aerosol former is volatilised upon heating and a stream of the aerosol former is contacted with the aerosol-forming substrate so as to entrain the flavours from the aerosol-forming substrate in the aerosol.

The aerosol-forming substrate may have an aerosol former content of about 30 percent by weight to about 45 percent by weight. This relatively high level of aerosol former is particularly suitable for aerosol-forming substrates that are intended to be heated at a temperature of less than 275 degrees Celsius. Where this is the case, the homogenised plant material preferably further comprises between about 2 percent by weight and about 10 percent by weight of cellulose ether, on a dry weight basis and between about 5 percent by weight and about 50 percent by weight of additional cellulose, on a dry weight basis. The use of the combination of cellulose ether and additional cellulose has been found to provide a particularly effective delivery of aerosol when used in an aerosol-forming substrate having an aerosol former content of between 30 percent by weight and 45 percent by weight.

Suitable cellulose ethers include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). In particularly preferred embodiments, the cellulose ether is carboxymethyl cellulose.

As used herein, the term "additional cellulose" encompasses any cellulosic material incorporated into the homogenised plant material which does not derive from the non-tobacco plant particles or tobacco particles provided in the homogenised plant material. The additional cellulose is therefore incorporated in the homogenised plant material in addition to the non-tobacco plant material or tobacco material, as a separate and distinct source of cellulose to any cellulose intrinsically provided within the non-tobacco plant particles or tobacco particles. The additional cellulose will typically derive from a different plant to the non-tobacco plant particles or tobacco particles. Preferably, the additional cellulose is in the form of an inert cellulosic material, which is sensorially inert and therefore does not substantially impact the organoleptic characteristics of the aerosol generated from the aerosol-forming substrate. For example, the additional cellulose is preferably a tasteless and odourless material.

The additional cellulose may comprise cellulose powder, cellulose fibres, or a combination thereof.

The aerosol former may act as a humectant in the aerosol-forming substrate.

The aerosol-generating article may comprise a mouthpiece element. The mouthpiece element may extend all the way to a mouth end of the aerosol-generating article.

The mouthpiece element may be located downstream of the hollow tubular element. Where the mouthpiece element is located downstream of the hollow tubular element, the mouthpiece element may extend all the way to the downstream end of the hollow tubular element. The mouthpiece element may be located immediately downstream of the hollow tubular element. By way of example, the mouthpiece element may abut the downstream end of the hollow tubular element.

The mouthpiece element is preferably located at the downstream end or mouth end of the aerosol-generating article. The mouthpiece element preferably comprises at least one mouthpiece filter segment for filtering the aerosol that is generated from the aerosol-forming substrate. For example, the mouthpiece element may comprise one or more segments of a fibrous filtration material. Suitable fibrous filtration materials would be known to the skilled person. Particularly preferably, the at least one mouthpiece filter segment comprises a cellulose acetate filter segment formed of cellulose acetate tow.

The mouthpiece element may comprise a mouth end cavity. The mouth end cavity may be defined by a hollow tubular element provided at the downstream end of the mouthpiece. Alternatively, the mouth end cavity may be defined by an outer wrapper of the aerosol-generating article at the mouth end.

The mouthpiece element may optionally comprise a flavourant, which may be provided in any suitable form. For example, the mouthpiece element may comprise one or more capsules, beads or granules of a flavourant, or one or more flavour loaded threads or filaments.

Preferably, the mouthpiece element has a low particulate filtration efficiency.

Preferably, the mouthpiece element is formed of a segment of a fibrous filtration material.

Preferably, the mouthpiece element is circumscribed by a plug wrap.

The mouthpiece element is preferably connected to one or more of the adjacent upstream components of the aerosol-generating article by means of a tipping wrapper.

Preferably, the mouthpiece element has an RTD of less than about 25 millimetres $H_2O$. More preferably, the mouthpiece element has an RTD of less than about 20 millimetres $H_2O$. Even more preferably, the mouthpiece element has an RTD of less than about 15 millimetres $H_2O$.

Values of RTD from about 10 millimetres $H_2O$ to about to about 15 millimetres $H_2O$ are particularly preferred because a mouthpiece element having one such RTD is expected to contribute minimally to the overall RTD of the aerosol-generating article and substantially does not exert a filtration action on the aerosol being delivered to the consumer.

The mouthpiece element preferably has an outer diameter that is approximately equal to the outer diameter of the aerosol-generating article. The mouthpiece element may have an outer diameter of between about 5 millimetres and about 10 millimetres, or between about 6 millimetres and about 8 millimetres. Preferably, the mouthpiece element has an outer diameter of approximately 7.2 millimetres.

The mouthpiece element may have a length of at least about 10 millimetres, more preferably at least about 11 millimetres, more preferably at least about 12 millimetres. The mouthpiece element may have a length of less than about 25 millimetres, more preferably less than about 20 millimetres, more preferably less than about 15 millimetres.

The mouthpiece element may have a length from about 10 millimetres to about 25 millimetres, more preferably from about 10 millimetres to about 20 millimetres, even more preferably from about 10 millimetres to about 15 millimetres. The mouthpiece element may have a length from about 11 millimetres to about 25 millimetres, more preferably from about 11 millimetres to about 20 millimetres, even more preferably from about 11 millimetres to about millimetres. The mouthpiece element may have a length from about 12 millimetres to about millimetres, more preferably from about 12 millimetres to about 20 millimetres, even more preferably from about 12 millimetres to about 20 millimetres.

Preferably, the mouthpiece element has a length of approximately 12 millimetres.

The provision of a relatively long mouthpiece element in the aerosol-generating article may allow the inclusion of a capsule, or allow the article to be more rigid at the position that the user applies the lips, or both.

The aerosol-generating article may have an overall length of about 20 millimetres or more, preferably about 30 millimetres or more, more preferably about 40 millimetres or more.

The aerosol-generating article may have an overall length of about 100 millimetres or less, preferably about 80 millimetres or less, more preferably about 60 millimetres or less.

The aerosol-generating article may have an overall length of between about 20 millimetres and about 100 millimetres, preferably between about 30 millimetres and about 80 millimetres, more preferably between about 40 millimetres and about 60 millimetres.

The aerosol-generating article may comprise a ventilation zone at a location along the hollow tubular element.

The hollow tubular element of the invention may comprise a ventilation zone at a location along the length of the hollow tubular element. Features of the ventilation zone are described below in respect of the aerosol-generating article. However, it will be appreciated that they may also apply to directly to the hollow tubular element itself.

The ventilation zone may be located between about 5 millimetres and about 15 millimetres from the folded end portion of the hollow tubular element. The ventilation zone may be located at least 2 millimetres from the upstream end of the hollow tubular element, more preferably at least 3 millimetres from the upstream end of the hollow tubular element, even more preferably at least 5 millimetres from the upstream end of the hollow tubular element.

The ventilation zone may be located less than 20 millimetres from the upstream end of the hollow tubular element, more preferably less than 15 millimetres from the upstream end of the hollow tubular element, even more preferably less than 10 millimetres from the upstream end of the hollow tubular element.

The ventilation zone may be located between about 1 millimetres and about 10 millimetres from the downstream end of the hollow tubular element, more preferably between about 2 millimetres and about 8 millimetres from the downstream end of the hollow tubular element, even more preferably between about 3 millimetres and about 6 millimetres from the downstream end of the hollow tubular element.

The ventilation zone may be located at least 1 millimetres from the downstream end of the hollow tubular element, more preferably the ventilation zone is located at least 2 millimetres from the downstream end of the hollow tubular element, even more preferably the ventilation zone is located at least 3 millimetres from the downstream end of the hollow tubular element.

The ventilation zone may be located less than 10 millimetres from the downstream end of the hollow tubular element, more preferably the ventilation zone is located less than 8 millimetres from the downstream end of the hollow tubular element, even more preferably the ventilation zone is located less than 6 millimetres from the downstream end of the hollow tubular element.

The ventilation zone may comprise a plurality of perforations through the peripheral wall of the ventilated element, which may be the hollow tubular element. Preferably, the ventilation zone comprises at least one circumferential row of perforations. The ventilation zone may comprise two circumferential rows of perforations. For example, the perforations may be formed online during manufacturing of the aerosol-generating article. Preferably, each circumferential row of perforations comprises from 8 to 30 perforations.

An aerosol-generating article in accordance with the present invention may have a ventilation level of at least about 5 percent.

The term "ventilation level" is used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer.

The aerosol-generating article may typically have a ventilation level of at least about percent, preferably at least about 15 percent, more preferably at least about 20 percent.

In preferred embodiments, the aerosol-generating article has a ventilation level of at least about 25 percent. The aerosol-generating article preferably has a ventilation level of less than about 60 percent. The aerosol-generating article may have a ventilation level of less than or equal to about 45 percent. More preferably, the aerosol-generating article may have a ventilation level of less than or equal to about 40 percent, even more preferably less than or equal to about 35 percent.

In a particularly preferred embodiments, the aerosol-generating article has a ventilation level of about 30 percent. The aerosol-generating article may have a ventilation level from about 20 percent to about 60 percent, preferably from about 20 percent to about 45 percent, more preferably from about 20 percent to about 40 percent The aerosol-generating article may have a ventilation level from about 25 percent to about 60 percent, preferably from about 25 percent to about 45 percent, more preferably from about 25 percent to about 40 percent. In further embodiments, the aerosol-generating article has a ventilation level from about 30 percent to about 60 percent, preferably from about 30 percent to about 45 percent, more preferably from about 30 percent to about 40 percent.

In some particularly preferred embodiments, the aerosol-generating article has a ventilation level from about 28 percent to about 42 percent. In some particularly preferred embodiments, the aerosol-generating article has a ventilation level of about 30 percent.

Embodiments where the aerosol-generating comprises a hollow tubular element downstream of the aerosol-generating substrate with a ventilation zone provided at a location along the first hollow tubular element may provide a number of advantages. For example, and without wishing to be bound by theory, the inventors have found that the temperature drop caused by the admission of cooler, external air into the first hollow tubular element via the ventilation zone may have an advantageous effect on the nucleation and growth of aerosol particles.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas-liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular element via the ventilation zone can be favourably used to favour nucleation and growth of aerosol droplets. However, at the same time, the admission of external air into the first hollow tubular element has the immediate drawback of diluting the aerosol stream delivered to the consumer.

The inventors have surprisingly found that the diluting effect on the aerosol—which can be assessed by measuring, in particular, the effect on the delivery of aerosol former (such as glycerol) included in the aerosol-generating substrate—is advantageously minimised when the ventilation level is within the ranges described above. In particular, ventilation levels between 25 percent and 50 percent, and even more preferably between 28 and 42 percent, have been found to lead to particularly satisfactory values of glycerin delivery. At the same time, the extent of nucleation and, as a consequence, the delivery of nicotine and aerosol-former (for example, glycerol) are enhanced.

The inventors have surprisingly found how the favourable effect of enhanced nucleation promoted by the rapid cooling induced by the introduction of ventilation air into the article is capable of significantly countering the less desirable effects of dilution. As such, satisfactory values of aerosol delivery are consistently achieved with aerosol-generating articles in accordance with the disclosure.

This is particularly advantageous with "short" aerosol-generating articles, such as ones wherein a length of the first element comprising the aerosol-generating substrate is less than about 40 millimetres, preferably less than 25 millimetres, even more preferably less than 20 millimetres, or wherein an overall length of the aerosol-generating article is less than about 70 millimetres, preferably less than about 60 millimetres, even more preferably less than 50 millimetres. As will be appreciated, in such aerosol-generating articles, there is little time and space for the aerosol to form and for the particulate phase of the aerosol to become available for delivery to the consumer.

Further, because the ventilated hollow tubular element can be configured to not substantially contribute to the overall RTD of the aerosol-generating article, in such an aerosol-generating articles the overall RTD of the article can advantageously be fine-tuned by adjusting the length and density of the first element comprising the aerosol-generating substrate or the length and optionally the length and density of a segment of filtration material forming part of the mouthpiece or the length and density of an element provided upstream of first element comprising the aerosol-generating substrate. Thus, aerosol-generating articles that have a predetermined RTD can be manufactured consistently and with great precision, such that satisfactory levels of RTD can be provided for the consumer even in the presence of ventilation.

Furthermore, the inventors have found that mixing of hot air from the aerosol-generating substrate with fresh air from the ventilation drawn through the ventilation holes may be particularly promoted when the support element does not divide the inner region of the hollow tubular element into a large number of discrete channels. In particular, it may be preferable to configure the support element so that the hollow inner region of the hollow tubular element consists of a single channel, for example of the type shown in any of FIGS. 4*a*, 6, and 8 in the appended drawings. With such arrangements, fresh air drawn through a line of ventilation holes extending around the circumference of the hollow tubular element may be substantially drawn into a single channel in the hollow inner region of the hollow tubular element. This may provide improved mixing of the fresh air from ventilation with the hot air from the aerosol-generating substrate.

Furthermore, it may be preferable to configure the hollow tubular element so that substantially all of the hot air drawn from the aerosol-generating substrate and through the section of the aerosol-generating article comprising the hollow tubular element is required to pass through the hollow inner region of the hollow tubular element. This may be achieved by ensuring there are no substantial gaps around the outside of the hollow tubular element, through which air may pass. For example, it may be preferable to configure the hollow tubular element so that the curved outer surface of the hollow tubular element is substantially continuous around the circumference of the hollow tubular element, for example as shown in any of FIGS. 6, 9, and 13-20 in the appended drawings. With such arrangements, fresh air drawn through a line of ventilation holes extending around the circumference of the hollow tubular element may be substantially drawn into a single channel in the hollow inner region of the hollow tubular element. This may provide improved mixing of the fresh air from ventilation with the hot air from the aerosol-generating substrate. This may also avoid a scenario where ventilation holes are required to extend through one or more walls of a support element. Such a configuration may be difficult to manufacture. Such a configuration may not result in an efficient passage of ventilation air into the hollow tubular element, for example, because of the orientation of the one or more walls.

Preferably, the hollow tubular element and its one or more support element are configured so that the hollow inner region of the hollow tubular support element consists of no more than three channels, more preferably no more than two channels, and even more preferably a single channel. Such an arrangement is particularly preferably when the aerosol-generating article has one or more of the ventilation features described above.

The present disclosure also relates to a method for forming a hollow tubular element for an aerosol-generating article. The method may comprise providing an apparatus for forming the hollow tubular element. The apparatus may comprise a device. The device may have an internal surface. The internal surface may define a channel of the device. The channel may extend from an upstream opening of the device. The channel may extend to a downstream opening of the device. The device may comprise an internal projection projecting into the channel. The method may also comprise providing a hollow tube. The method may further comprise passing the hollow tube into the channel through the upstream opening of the device. The method may further comprise passing the tube along the channel and into contact with the internal projection of the device, such that the tube is folded by the internal projection to form a hollow tubular element having a support element.

According to the present invention, the method comprises providing an apparatus for forming the hollow tubular element. The apparatus comprises a device. The device has an internal surface defining a channel. The channel extends from an upstream opening of the device to a downstream opening of the device. The device comprises an internal projection projecting into the channel. The method also comprises providing a hollow tube. The method further comprises passing the hollow tube into the channel through the upstream opening of the device; passing the tube along the channel and into contact with the internal projection of the device; such that the tube is folded by the internal projection to form a hollow tubular element having a support element.

The method may also comprise passing the hollow tubular element out of the channel through the downstream opening of the device.

The hollow tube may be formed from a sheet. The method may comprise forming the hollow tube from a sheet. Forming the hollow tube from a sheet may comprise forming a seam by overlapping a portion of the sheet at a first end of the sheet with a portion of the sheet at an opposed second end of the sheet. Forming the seam may comprise attaching the portion of the sheet at the first end of the sheet to the portion of the sheet at the second end of the sheet by an adhesive. The seam may extend along the length of the hollow tube.

A diameter of the hollow tube may be about the same as a perimeter of the hollow tubular element.

The channel may have a substantially circular cross section. The channel may comprise a substantially cylindrical section. The channel may comprise a substantially frustoconical section.

The internal projection may have a substantially constant cross section along the entire length of the internal projection. The internal projection may have a cross section that varies along the length of the internal projection. For example, the internal projection may taper. For instance, the internal projection may taper off at an upstream end of the internal projection. The length of the internal projection may extend in the direction that the hollow tube passes through the device.

The internal projection may have a substantially rectangular cross section in one or both of the longitudinal direction and the transverse direction. The internal projection may have a substantially triangular cross section in one or both of the longitudinal direction and the transverse direction. Preferably, the internal projection has a triangular cross section in the transverse direction. A triangular cross section in the transverse direction may assist with folding of the hollow tube to form a hollow tubular element, and may avoid tearing through the hollow tube. The internal projection may be substantially pyramidal.

Where the internal projection is substantially pyramidal, the internal projection may have a maximum transverse cross-sectional area at an apex of the internal projection.

Where the internal projection has a substantially triangular cross section in the transverse direction, for example when the internal projection is substantially pyramidal, the internal projection may comprise a first edge. The first edge may be adjacent to a portion of the internal surface of the device that defines the channel. The internal projection may comprise a second edge. The second edge may be adjacent to a portion of the internal surface of the device that defines the channel. The second edge may extend from an upstream end of the internal projection. The internal projection may comprise a third edge. The third edge may reside within the channel. The third edge may extend from the upstream end of the internal projection. The third edge may extend to an apex of the internal projection. The third edge may define a tip of the internal projection.

The hollow tube may have a circumference about equal to the internal perimeter of a transverse cross section of the device at the apex of the internal projection.

The internal projection may be a first internal projection and the device may comprise one or more additional internal projections. The device may comprise between two and six internal projections. Preferably, the device comprises three internal projections. Each of the internal projections may be identical to one another. Alternatively, one of the internal projections may be different to another internal projection. The internal projections may be equally spaced around the channel.

The internal shape of the device may be configured such that a snug fit is achieved between the hollow tube and the internal surface of the device defining the channel. This may be particularly desirable at points where the hollow tube is in contact with one or more of the internal projections. This may help with folding of the hollow tube at desired positions to form a hollow tubular element.

The device may comprise a first section. The first section of the device may comprise at least part of the channel of the device. The channel may have a substantially constant cross section along the entire length of the first section of the device. For instance, the part of the channel extending through the first section of the device may be substantially cylindrical. A cross section of the channel may vary along the length of the first section of the device. For instance, a cross-sectional area of the channel at an upstream end of the first section of the device may be larger than a cross-sectional area of the channel at a downstream end of the first section of the device. Preferably, the part of the channel extending through the first section of the device is substantially frustoconical. Where this is the case, preferably the diameter of the channel of the device at the upstream end of the first section is greater than the diameter of the channel of the device at the downstream end of the first section. A diameter of the channel of the device at a point along the first section, for example at the upstream end of the first section, may be about the same as a diameter of the hollow tube. The diameter of the channel at a point along the first section, for example at the downstream end of the first section, may be about the same as the diameter of the hollow tubular element. The diameter of the channel may be selected such that an outer surface of the hollow tube remains in contact with an inner surface of the device, during a step of passing the hollow tube through the first section of the device, to assist with shaping of the hollow tube into a hollow tubular element.

The internal projection may be a part of the first section of the device. That is, the first section of the device may comprise the internal projection projecting into the channel. The internal projection may extend from an upstream end of the first section of the device to a downstream end of the first section of the device. As such, the internal projection may extend along the entire length of the first section of the device. The internal projection may project into the part of the channel that extends through the first section of the device. Where the internal projection tapers, the internal projection may taper off at the upstream end of the first section of the device. In addition, where the internal projection comprises a first edge, the first edge may extend from the upstream end of the first section of the device. Where the internal projection comprises a section edge, the second edge may extend from the upstream end of the first section of the device. Where the internal projection comprises a third edge, the third edge may extend from the upstream end of the first section of the device. The third edge may reside within the channel.

The first section of the device may extend from the upstream opening of the device to the downstream opening of the device. In this case, the first section of the device may be the only section of the device. That is, the device may comprise only the first section of the device.

In addition to the first section, the device may comprise one or more additional sections.

For example, the device may comprise a second section. The second section of the device may comprise at least part of the channel of the device. The second section may extend from the upstream opening of the device. The second section may extend to the first section of the device. In other words, the second section may be adjacent to, and upstream from, the first section of the device.

The part of the channel extending through the second section may have a substantially circular cross section. Preferably, the part of the channel extending through the second section has a substantially circular cross section at the downstream end of the second section. Where this is the case, preferably a diameter of the channel at a downstream end of the second section is about the same as a diameter of the channel at the upstream end of the first section.

The channel may have a larger cross sectional area at the upstream end of the second section than at the downstream end of the second section. The part of the channel extending through the second section may be substantially frustoconical.

The part of the channel extending through the second section may have a substantially constant cross section along the entire length of the second section. The part of the channel extending through the second section may be substantially cylindrical.

The device may comprise a third section. The third section of the device may comprise at least part of the channel of the device. The third section may extend from the downstream end of the first section of the device. The third section may extend to the downstream opening of the device. In other words, the third section may be adjacent to, and downstream from, the first section of the device.

The part of the channel extending through the third section may have a substantially circular cross section. Preferably, the part of the channel extending through the third section has a substantially circular cross section at the upstream end of the third section. Where this is the case, preferably a diameter of the channel at an upstream end of the third section is about the same as a diameter of the channel at the downstream end of the first section.

The channel may have a larger cross sectional area at the downstream end of the third section than at the upstream end of the third section. The part of the channel extending through the third section may be substantially frustoconical.

The part of the channel extending through the third section may have a substantially constant cross section along the entire length of the third section. The part of the channel extending through the third section may be substantially cylindrical.

The device may comprise only the first section and the third section. The device may comprise a first section, a second section and a third section. Where this is the case, the first section may be located between the second section and the third section of the device.

The method comprises passing the hollow tube into the channel of the device through the upstream opening of the device.

The method also comprises passing the hollow tube along the channel and into contact with the internal projection of the device. Where the device comprises a first section comprising the internal projection, the method may comprise passing the hollow tube along the channel and into contact with the internal projection at the upstream end of the first section of the device. The method may also comprise passing the hollow tube along the channel through the first section of the device, such that an outer surface of the hollow tube is in contact with the internal surface of the first section of device. The method may also comprise passing the hollow tube along the channel through the first section of the device, such that an outer surface of the hollow tube is in contact with the internal projection. Due to the configuration of the first section of the device, passing the hollow tube along the first section of the device may cause the hollow tube to deform and conform to the internal shape of the first section of the device. In particular, where the part of the channel extending through the first section has a substantially frustoconical shape, the shape of the channel in the first section combined with the presence of the internal projection in the first section, may help to shape the hollow tube into a form having a reduced diameter and an internal folded projection forming a support element. Consequently, passing the hollow tube through the first section of the device may cause the hollow tube to form: a first fold line at a first edge of the internal projection, a second fold line at a second edge of the internal projection; and a third fold line at a third edge of the internal projection. As such, passing the hollow tube through the first section of the device may form a hollow tubular element formed from a sheet, the hollow tubular element comprising: a peripheral portion defining a hollow inner region, and a support element; wherein the support element depends from the peripheral portion along both a first fold line of the sheet and a second fold line of the sheet; and wherein the support element comprises a third fold line of the sheet residing within the hollow inner region.

The method may comprise passing the hollow tubular element out of the channel through the downstream opening of the device.

Where the device comprises a second section extending from the upstream opening of the device to the upstream end of a first section of the device, the method comprises passing the hollow tube through the second section of the device, along the channel, prior to passing the hollow tube through the first section of the device. Passing the hollow tube through the second section of the device may assist with insertion of the hollow tube into the channel and into contact with the internal projection.

Where the device comprises a third section extending from the downstream end of a first section of the device to the downstream opening of the device, the method may comprise passing the hollow tube through the third section of the device, along the channel, following passing the hollow tube through the first section of the device. The method may comprise passing the hollow tubular element through the third section of the device and out of the channel through the downstream opening of the device. Passing the hollow tubular element through the third section of the device may also assist with the exiting of the hollow tubular element out of the device. Passing the hollow tubular element through the third section of the device may help to retain the desired shape of the hollow tubular element after folding of the hollow tubular element, for example, by helping to retain the desired curvature of the hollow tubular element.

The method may comprise attaching a first side wall of the support element to a second side wall of the support element by an adhesive, where the first side wall of the support element extends from the first fold line to the third fold line, and the second side wall of the support element extends from the second fold line to the third fold line. The attaching step may be performed before the hollow tubular element has exited the device. In this case, the attaching step may be performed whilst the hollow tubular element is being passed through the channel. The attaching step may be performed after the hollow tubular element has exited the device.

The method may comprise circumscribing a wrapper around the hollow tubular element. The circumscribing step may be performed before the hollow tubular element has exited the device. The circumscribing step may be performed after the hollow tubular element has exited the device.

The method may comprise attaching a wrapper to the hollow tubular element, for example, by an adhesive. The step of attaching a wrapper to the hollow tubular element may be performed before the hollow tubular element has exited the device. The step of attaching a wrapper to the hollow tubular element may be performed after the hollow tubular element has exited the device.

Features described in relation to one example or embodiment may also be applicable to other examples and embodiments.

Below, there is provided a non-exhaustive list of non-limiting examples. Any one or more of the features of these examples may be combined with any one or more feature of another example, or embodiment described herein.

EX1. An aerosol-generating article comprising: a first element comprising an aerosol-forming substrate; and a hollow tubular element disposed downstream of the first element, wherein the hollow tubular element comprises: a peripheral portion defining a hollow inner region of the hollow tubular element; and a support element formed from a sheet and extending from a first point at the peripheral portion across the hollow inner region to a second point at the peripheral portion, and wherein the hollow tubular element has an average weight of about 10 milligrams per millimetre length or less.

EX2. An aerosol-generating article according to any one of EX1, wherein the peripheral portion is formed from a sheet.

EX3. An aerosol-generating article according to EX2, wherein the peripheral portion and the support element are integrally formed from a sheet.

EX4. An aerosol-generating article according to EX3, wherein the peripheral portion and the support element are formed from separate sheets.

EX5. An aerosol-generating article according to any one of EX1 to EX4, wherein the peripheral portion comprises a tube.

EX6. An aerosol-generating article according to any one of EX1 to EX5, wherein the support element extends along between about 10 percent and about 100 percent of the length of the hollow tubular element.

EX7. An aerosol-generating article according to any one of EX1 to EX6, wherein the first point at the peripheral portion and the second point at the peripheral portion are spaced apart from each other.

EX8. An aerosol-generating article according to EX7, wherein the first point at the peripheral portion and the second point at the peripheral portion are substantially diametrically opposed.

EX9. An aerosol-generating article according to any one of EX1 to EX6, wherein the first point at the peripheral portion and the second point at the peripheral portion are adjacent to each other.

EX10. An aerosol-generating article according to EX9, wherein the first point at the peripheral portion and the second point at the peripheral portion are in contact with each other.

EX11. An aerosol-generating article according to any one of EX1 to EX10, wherein the support element comprises a tip, the tip being positioned within the hollow inner region.

EX12. An aerosol-generating article according to EX11, wherein the tip of the support element is spaced apart from the peripheral portion.

EX13. An aerosol-generating article according to any one of EX11, wherein the tip of the support element resides at a point which is adjacent to a point at the peripheral portion.

EX14. An aerosol-generating article according to any one of EX1 to EX13, wherein a surface of the support element along the longitudinal direction is substantially planar.

EX15. An aerosol-generating article according to EX14, wherein the substantially planar surface extends from the first point at the peripheral portion.

EX16. An aerosol-generating article according to any one of EX14 to EX15, wherein the substantially planar surface extends to the second point at the peripheral portion.

EX17. An aerosol-generating article according to any one of EX1 to EX16, wherein the support element comprises a substantially straight portion, when viewed from the upstream end of the hollow tubular element.

EX18. An aerosol-generating article according to EX17, wherein the substantially straight portion extends from the first point at the peripheral portion, when viewed from the upstream end of the hollow tubular element.

EX19. An aerosol-generating article according to any one of EX17 to EX18, wherein the substantially straight portion extends to the second point at the peripheral portion, when viewed from the upstream end of the hollow tubular element.

EX20. An aerosol-generating article according to any one of EX1 to EX19, wherein the support elements depends from the peripheral portion along a first fold line of the sheet, wherein the first fold line resides at the first point at the peripheral portion.

EX21. An aerosol-generating article according to EX20, wherein the first fold line extends along part of the length of the hollow tubular element.

EX22. An aerosol-generating article according to EX21, wherein the first fold line extends along substantially the entire length of the hollow tubular element.

EX23. An aerosol-generating article according to any one of EX20 to EX22, wherein the first fold line is parallel to the longitudinal axis of the hollow tubular element.

EX24. An aerosol-generating article according to any one of EX20 to EX22, wherein the first fold line is non-parallel to the longitudinal axis of the hollow tubular element.

EX25. An aerosol-generating article according to any one of EX20 to EX24, wherein the first fold line is the only fold line along which the support element depends from the peripheral portion.

EX26. An aerosol-generating article according to any one of EX20 to EX24, wherein the support element depends from the peripheral portion along a second fold line of the sheet, wherein the second fold line resides at the second point at the peripheral portion.

EX27. An aerosol-generating article according to EX26, wherein the second fold line extends along part of the length of the hollow tubular element.

EX28. An aerosol-generating article according to EX27, wherein the second fold line extends along substantially the entire length of the hollow tubular element.

EX29. An aerosol-generating article according to any one of EX26 to EX28, wherein the second fold line is parallel to the longitudinal axis of the hollow tubular element.

EX30. An aerosol-generating article according to any one of EX26 to EX28, wherein the first fold line is non-parallel to the longitudinal axis of the hollow tubular element.

EX31. An aerosol-generating article according to any one of EX26 to EX30, wherein the first fold line and the second fold line are parallel to each other.

EX32. An aerosol-generating article according to EX26 to EX30, wherein the first fold line and the second fold line are non-parallel to each other.

EX33. An aerosol-generating article according to any one of EX26 to EX32, wherein the support element comprises a third fold line of the sheet.

EX34. An aerosol-generating article according to EX33 wherein the third fold line defines a tip of the support element, the tip being positioned within the hollow inner region.

EX35. An aerosol-generating article according to any one of EX33 to EX34, wherein the third fold line of the sheet is positioned about equidistant from the first fold line of the sheet and the second fold line of the sheet.

EX36. An aerosol-generating article according to any one of EX33 to EX35, wherein the first fold line and the third fold line define a first side wall of the support element.

EX37. An aerosol-generating article according to EX36, wherein the first side wall of the support element is substantially straight.

EX38. An aerosol-generating article according to any one of EX36 to EX37, wherein the second fold line and the third fold line define a second side wall of the support element.

EX39. An aerosol-generating article according to EX38, wherein the second side wall of the support element is substantially straight.

EX40. An aerosol-generating article according to any one of EX38 to EX39, wherein a surface of the first side wall and a surface of the second side wall are in contact with each other.

EX41. An aerosol-generating article according to EX39, wherein both the first side wall and the second side wall are substantially straight, and wherein the first side wall and the second side wall define an angle of about 5 degrees or more therebetween.

EX42. An aerosol-generating article according to any one of EX1 to EX41, wherein the support element has a substantially triangular cross section.

EX43. An aerosol-generating article according to any one of EX38 to EX40, wherein both the first side wall and the second side wall are substantially straight, and wherein the angle formed between the first side wall and the second side wall is approximately zero degrees.

EX44. An aerosol-generating article according to any one of EX1 to EX40, wherein a cross section of the support element comprises a curved portion.

EX45. An aerosol-generating article according to any one of EX1 to EX40 and EX44, wherein the support element comprises a plurality of peaks and troughs, when viewed from the upstream end of the hollow tubular element.

EX46. An aerosol-generating article according to any one of EX1 to EX40, EX44 and EX45 wherein the support element has a wave profile, when viewed from the upstream end of the hollow tubular element.

EX47. An aerosol-generating article according to EX46, wherein the support element is substantially sinusoidal, when viewed from the upstream end of the hollow tubular element.

EX48. An aerosol-generating article according to EX46, wherein the support element has a substantially triangular wave profile, when viewed from the upstream end of the hollow tubular element.

EX49. An aerosol-generating article according to any one of EX44, EX46 and EX47, wherein a cross section of the support element is substantially s-shaped.

EX50. An aerosol-generating article according to EX44, wherein a cross section of the support element is substantially omega-shaped.

EX51. An aerosol-generating article according to EX44, wherein a cross section of the support element is substantially c-shaped.

EX52. An aerosol-generating article according to any one of EX45, EX46 and EX48, wherein the support element is substantially w-shaped, when viewed from the upstream end of the hollow tubular element.

EX53. An aerosol-generating article according to any one of EX1 to EX52, wherein the hollow tubular element comprises at least one longitudinal plane of symmetry.

EX54. An aerosol-generating article according to any one of EX1 to EX53, wherein the hollow tubular element is radially symmetric.

EX55. An aerosol-generating article according to any one of EX1 to EX54, wherein the cross-sectional area of the hollow tubular element is substantially constant along the entire length of the hollow tubular element.

EX56. An aerosol-generating article according to any one of EX1 to EX55, wherein the hollow tubular element has a substantially constant cross section along the entire length of the hollow tubular element.

EX57. An aerosol-generating article according to any one of EX1 to EX56, wherein the support element divides the hollow inner region into a plurality of channels.

EX58. An aerosol-generating article according to EX57, wherein the support element divides the hollow inner region into between two and four channels.

EX59. An aerosol-generating article according to any one of EX1 to EX58, wherein the support element extends through the radial centre of the hollow tubular element.

EX60. An aerosol-generating article according to any one of EX1 to EX59, wherein the support element is spaced apart from the radial centre of the hollow tubular element by a distance of between about 5 percent and about 90 percent of the radius of the hollow tubular element.

EX61. An aerosol-generating article according to any one of EX1 to EX60, wherein the support element is spaced apart from the radial centre of the hollow tubular element by a distance of between about 0.2 millimetres and about 3 millimetres.

EX62. An aerosol-generating article according to any one of EX1 to EX61, wherein the support element comprises a tip, and the support element has a depth of between about 0.6 millimetres and about 3 millimetres.

EX63. An aerosol-generating article according to any one of EX1 to EX62, wherein the support element is the only support element of the hollow tubular element.

EX64. An aerosol-generating article according to any one of EX1 to EX62, wherein the hollow tubular element comprises a plurality of support elements.

EX65. An aerosol-generating article according to EX64, wherein the hollow tubular element comprises between two and six support elements.

EX66. An aerosol-generating article according to EX65, wherein the hollow tubular element comprises three support elements.

EX67. An aerosol-generating article according to any one of EX64 to EX66, wherein each of the support elements are identical to one another.

EX68. An aerosol-generating article according to any one of EX64 to EX67, wherein each of the support elements are about equally spaced around the peripheral portion of the hollow tubular element.

EX69. An aerosol-generating article according to any one of EX1 to EX68, wherein the hollow tubular element has a length of between about 10 millimetres and about 30 millimetres.

EX70. An aerosol-generating article according to any one of EX1 to EX69, wherein the hollow tubular element has an outer diameter of between about 5 millimetres and about 12 millimetres.

EX71. An aerosol-generating article according to any one of EX1 to EX70, wherein the hollow tubular element has an inner diameter of between about 4.5 millimetres and about 11.5 millimetres.

EX72. An aerosol-generating article according to any one of EX1 to EX71, wherein the hollow tubular element has a total internal surface area of between about 25 millimetres squared per millimetre length and about 70 millimetres squared per millimetre length.

EX73. An aerosol-generating article according to any one of EX1 to EX72, wherein the hollow tubular element provides a negligible level of resistance to draw.

EX74. An aerosol-generating article according to any one of EX1 to EX73, wherein the hollow tubular element has a porosity of about 90 percent or more in the longitudinal direction.

EX75. An aerosol-generating article according to any one of EX1 to EX74, wherein the sheet forming one or both of the support element and the peripheral portion is formed from paper, any other paper-based material, any other cellulosic-based material, a bioplastic-based material, or a metal.

EX76. An aerosol-generating article according to EX75, wherein the sheet forming one or both of the support element and the peripheral portion is formed from paper.

EX77. An aerosol-generating article according to any one of EX1 to EX76, wherein the sheet forming one or both of the peripheral portion and the support element has a basis weight of between about 35 grams per square metre and about 80 grams per square metre.

EX78. An aerosol-generating article according to any one of EX1 to EX77, wherein the sheet forming one or both of the peripheral portion and the support element has a thickness of between about 100 micrometres and about 130 micrometres.

EX79. An aerosol-generating article according to any one of EX1 to EX78, wherein the sheet forming one or both of the support element and the peripheral portion is an aluminium sheet, and the sheet has a thickness of between about 10 micrometres and about micrometres.

EX80. An aerosol-generating article according to any one of EX1 to EX79, wherein substantially the entirety of the support element is formed from a single layer of the sheet that forms the support element.

EX81. An aerosol-generating article according to any one of EX1 to EX80, wherein the peripheral portion is formed from a single layer of a sheet.

EX82. An aerosol-generating article according to any one of EX1 to EX80, wherein the peripheral portion is formed from a plurality of overlapping layers of a sheet.

EX83. An aerosol-generating article according to any one of EX1 to EX80, wherein the peripheral portion is formed from multiple sheets.

EX84. An aerosol-generating article according to any one of EX1 to EX83, wherein the peripheral portion has a thickness of between about 15 micrometres and about 600 micrometres.

EX85. An aerosol-generating article according to EX84, wherein the peripheral portion has a thickness of between about 100 micrometres and about 130 micrometres.

EX86. An aerosol-generating article according to any one of EX1 to EX85, wherein the hollow tubular element has an overall weight of about 150 milligrams or less.

EX87. An aerosol-generating article according to any one of EX1 to EX86, wherein the hollow tubular element has an average weight of about 6 milligrams per millimetre length of the hollow tubular element or less.

EX88. An aerosol-generating article according to any one of EX1 to EX87, wherein the hollow tubular element is circumscribed by a wrapper.

EX89. An aerosol-generating article according to any one of EX1 to EX88, wherein the hollow tubular element is connected to one or more of the adjacent components of the aerosol-generating article by means of a wrapper.

EX90. An aerosol-generating article according to any one of EX1 to EX89, wherein the hollow tubular element comprises an adhesive.

EX91. An aerosol-generating article according to any one of EX1 to EX90, wherein the sheet comprises a flame retardant portion comprising a flame retardant composition.

EX92. An aerosol-generating article according to EX91, wherein the flame retardant portion extends from the upstream end of the hollow tubular element.

EX93. An aerosol-generating article according to EX91 or EX92, wherein the flame retardant portion extends over one or both of the inner surface and the outer surface of the hollow tubular element.

EX94. An aerosol-generating article according to EX93, wherein the flame retardant portion extends over one or both of substantially the entirety of the inner surface and outer surface of the hollow tubular element.

EX95. An aerosol-generating article according to any one of EX1 to EX94, further comprising a first element comprising an aerosol forming substrate and a susceptor, and preferably wherein the susceptor is at the downstream end of the first element.

EX96. An aerosol-generating article according to EX95, wherein the susceptor is arranged within the aerosol-forming substrate.

EX97. An aerosol-generating article according to EX95 or EX96, wherein the susceptor is arranged around the aerosol-forming substrate.

EX98. An aerosol-generating article according to any one of EX1 to EX97, further comprising a ventilation zone at a location along the hollow tubular element.

Embodiments of the invention will now be described in detail, by way of example only, with reference to the accompanying drawings, in which.

Figure 1:
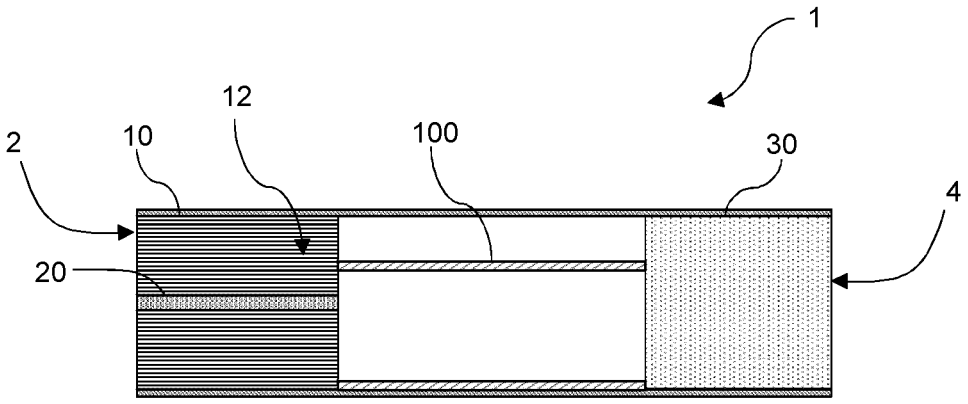
FIG. 1 shows a schematic side sectional view of an aerosol-generating article in accordance with a first embodiment of the present invention.

FIG. 1 shows an aerosol-generating article 1 in accordance with a first embodiment of the present invention. The aerosol-generating article 1 comprises a first element 10 comprising an aerosol-forming substrate 12; a susceptor element 20 arranged within the first element 10; a hollow tubular element 100 disposed downstream of the first element 10; and a mouth end element 30. Thus, the aerosol-generating article extends from an upstream or distal end 2 to a downstream or mouth end 4.

The aerosol-generating article has an overall length of about 45 millimetres.

The first element 10 is in the form of a rod comprising the aerosol-forming substrate 12 of one of the types described above. The structure and dimensions of the first element 10 are defined by the aerosol-forming substrate 12, which is also in the form of a rod. The first element 10 comprising the aerosol-forming substrate 12 has an outer diameter of about 7.25 millimetres and a length of about 12 millimetres.

The susceptor element 20 is an elongate susceptor element 20. The susceptor element 20 is arranged substantially longitudinally within the first element 10, such as to be approximately parallel to the longitudinal direction of the first element 10. The susceptor element 20 is positioned in a radially central position within the first element 10 and extends effectively along the entire longitudinal axis of the first element 10. In particular, the susceptor element 20 is arranged substantially longitudinally within the aerosol-forming substrate 12 and positioned in a radially central position with the aerosol-forming substrate 12. The susceptor element 20 extends all the way from an upstream end to a downstream end of the aerosol-forming substrate 12. In effect, the susceptor element 20 has substantially the same length as the first element 10 and the aerosol-forming substrate 12.

The susceptor element 20 is provided in the form of a strip and has a length of about 12 millimetres, a thickness of about 60 micrometres, and a width of about 4 millimetres.

The hollow tubular element 100 is disposed immediately downstream of the first element 10, the hollow tubular element 100 being in longitudinal alignment with the first element 10. The upstream end of the hollow tubular element 100 abuts the downstream end of the first element 10 and in particular, the downstream end of the aerosol-forming substrate 10. This advantageously prevents or restricts movement of both the first element 10 and the susceptor element 20.

The mouthpiece element 30 is disposed immediately downstream of the hollow tubular element 100, the mouthpiece element 30 being in longitudinal alignment with the hollow tubular element. The upstream end of the mouthpiece element 30 abuts the downstream end of the hollow tubular element 100.

The mouthpiece element 30 is provided in the form of a cylindrical plug of low-density cellulose acetate. The mouthpiece element 30 has a length of about 12 millimetres and an outer diameter of about 7.25 millimetres. The RTD of the mouthpiece element 30 is about 12 millimetres $H_2O$.

Figure 2:
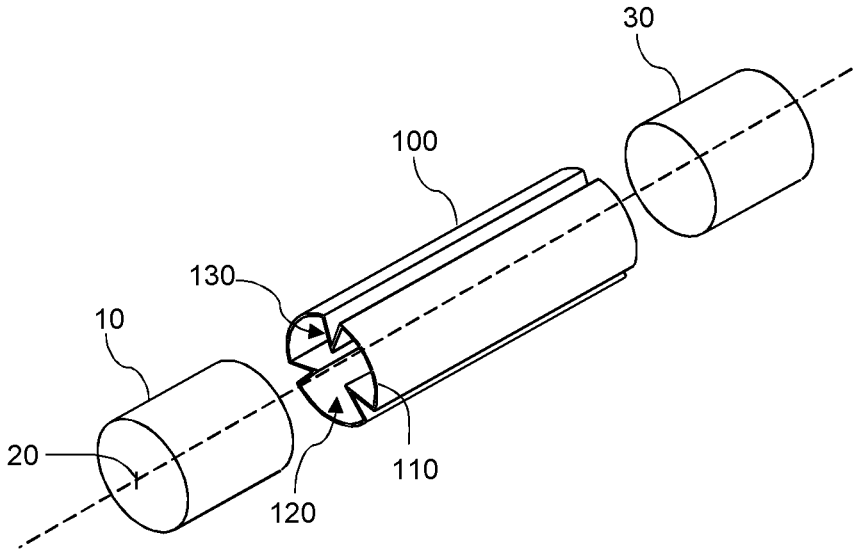
FIG. 2 shows an exploded view of some of the components of the aerosol-generating article of FIG. 1.
Figure 3:
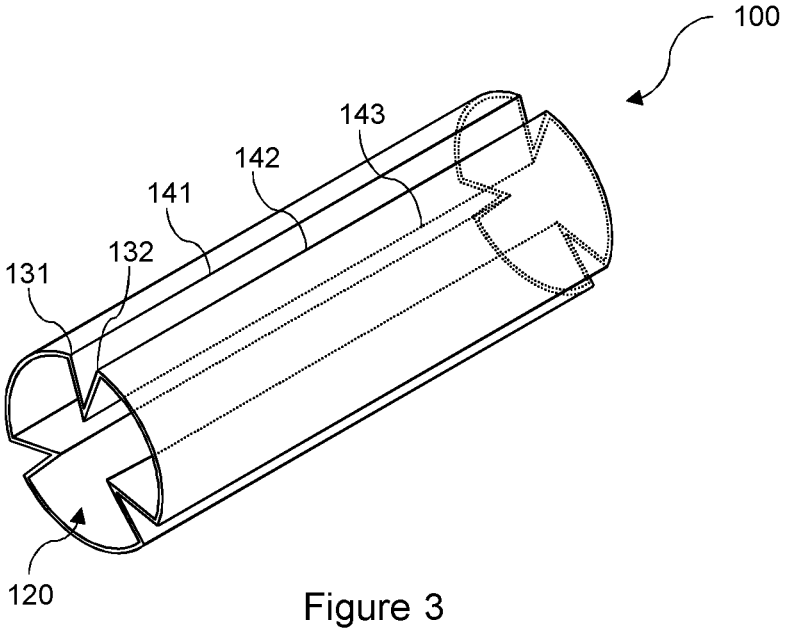
FIG. 3 shows a partially transparent perspective view of a hollow tubular element of the aerosol-generating article of FIG. 1.

The hollow tubular element 100 is best seen in the exploded perspective view of some of the components of the aerosol-generating article 1 in FIG. 2 and in the partially transparent perspective view of the hollow tubular element in FIG. 3.

The hollow tubular element 100 comprises a peripheral portion 110 of material defining a hollow inner region 120 of the hollow tubular element 100. The hollow tubular element 100 also comprises a support element 130 formed from a sheet and extending from a first point 131 at the peripheral portion 110 across the hollow inner region 120 to a second point 132 at the peripheral portion 110.

The peripheral portion 110 and the support element 130 are integrally formed from the same sheet of paper. The paper sheet has a basis weight of about 78 grams per square metre. Substantially the entirety of the portion of the sheet forming the peripheral portion 110 forms a curved outer surface of the hollow tubular element 100.

To form the support element 130 the paper sheet comprises a seam (not shown), wherein two layers of the paper sheet overlap each other. The seam may be a part of one or both of the peripheral portion 110 and the support element 130. The seam extends over a small portion of one or both of the peripheral portion 110 and the support element 130. As such, substantially the entirety of the peripheral portion 110 is formed from a single layer of the sheet. In addition, substantially the entirety of the support element 130 is formed from a single layer of the sheet.

The support element 130 depends from the peripheral portion 110 along a first fold line 141 of the sheet, wherein the first fold line 141 resides at the first point 131 at the peripheral portion 110, and wherein the first fold line 141 extends along substantially the entire length of the hollow tubular element 100. The support element 130 also depends from the peripheral portion 110 along a second fold line 142 of the sheet, wherein the second fold line 142 resides at the second point 132 at the peripheral portion 110, and wherein the second fold line 142 extends along substantially the entire length of the hollow tubular element 100.

As such, the support element 130 also extends along substantially the entire length of the hollow tubular element 100. In effect, the support element 130 has substantially the same length as the hollow tubular element 100.

The hollow tubular element 100 has a length of about 8 millimetres.

The hollow tubular element 100 has a total weight of about 34 milligrams. As such, the hollow tubular element has an average weight of about 4.25 milligrams grams per millimetre.

The hollow tubular element 100 has a constant cross section along the entire length of the hollow tubular element 100.

The first fold line 141 and the second fold line 142 are both parallel to the longitudinal axis of the hollow tubular element 100. As such, the first fold line 141 and the second fold line 142 are parallel to each other.

As illustrated in FIG. 3, the support element 130 comprises a third fold line 143 of the sheet, wherein the third fold line 143 is parallel to and equidistant between the first fold line 141 and the second fold line 142. This helps to provide a strong support barrier to prevent or reduce movement of the first element 10, in particular the aerosol-forming substrate 12, and the susceptor element 20. The third fold line 143 defines the tip of the support element.

Figure 4A:
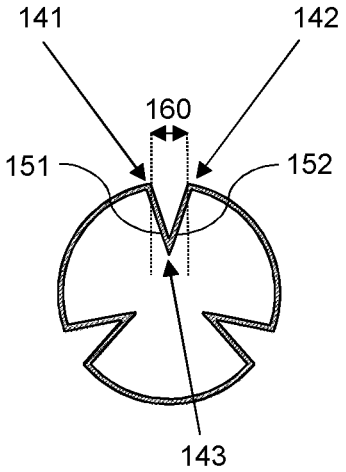
FIGS. 4A and 4B show a cross-sectional view of the upstream end face of the hollow tubular element of the aerosol-generating article of FIG. 1.
Figure 4B:
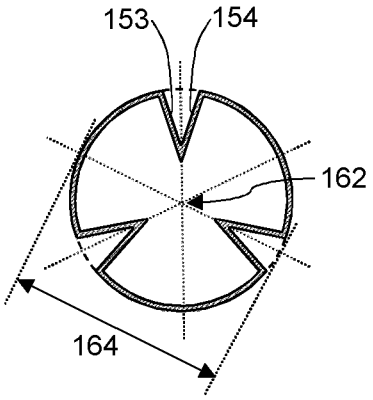

FIGS. 4A and 4B show a cross-sectional view of the upstream end face of the hollow tubular element 100.

The first fold line 141 and the third fold line 143 together define a first side wall 151 of the support element 130, wherein the first side wall 151 is substantially straight and the outer surface 153 of the first side wall 151 forms an outer surface of the hollow tubular element 100. The second fold line 142 and the third fold line 143 together define a second side wall 151 of the support element 130, wherein the second side wall 152 is substantially straight and the outer surface 154 of the second side wall 152 forms an outer surface of the hollow tubular element.

The support element 130 has a generally triangular cross section.

The first point 131 at the peripheral portion 110 and the second point 132 at the peripheral portion 110 are spaced apart from each other by a distance 160 of about 1 millimetre. As such, the first fold line 141 and the second fold line 142 are also spaced apart from each other by a distance of about 1 millimetre.

The first side wall 151 and the second side wall 152 define an angle of about 30 degrees therebetween.

The depth of the support element 130 is about 2 millimetres. That is, the distance between the first point 131 at the peripheral portion and the tip of the support element 130 is about 2 millimetres. As such, the distance between the first fold line 141 and the third fold line 143 is also about 2 millimetres.

The tip of the support element 130 is spaced apart from the radial centre 162 of the hollow tubular element 100 by a distance of about 1.5 millimetres. As such, the support element 130 is spaced apart from the radial centre 162 of the hollow tubular element by a distance of about 1.5 millimetres.

The outer diameter 164 of the hollow tubular element is about 7.2 millimetres. As such, the support element 130 is spaced apart from the radial centre 162 of the hollow tubular element 100 by a distance of about 42 percent of the radius of the hollow tubular element 100.

Figure 4C:
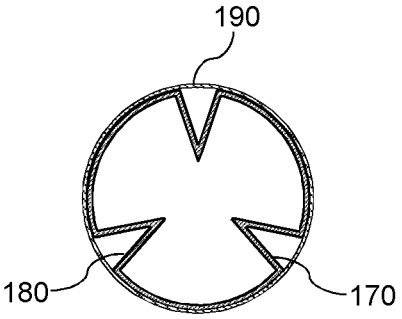
FIG. 4C shows a cross-sectional view of the aerosol-generating article at the hollow tubular element of FIG. 1.

FIG. 4C shows a wrapper 190 circumscribing the hollow tubular element 100.

The support element 130 is a first support element 130 and the hollow tubular element comprises two additional support elements: a second support element 170 and a third support element 180. This may advantageously provide the hollow tubular element 100 with additional strength and stiffness in both the longitudinal direction and the transverse direction to prevent or restrict movement of the first element 110, in particular the aerosol-forming substrate 112, and the susceptor element 120; whilst avoiding deformation of the hollow tubular element 100.

Each of the support elements 130, 170, 180 are identical to one another and are equally spaced around the circumference of the hollow tubular element 100. The circumference of the hollow tubular element 100 is illustrated by the dashed curved lines in FIG. 4B.

Figure 5:
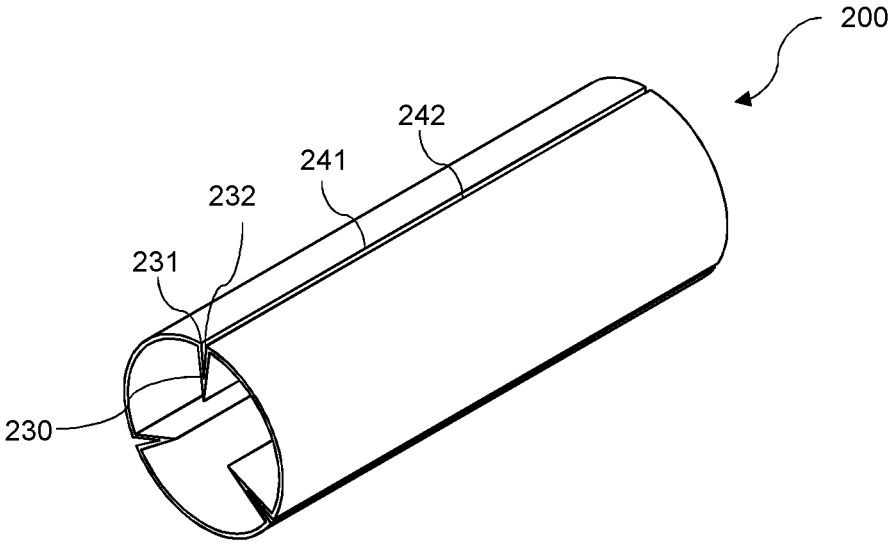
FIG. 5 shows a perspective view of a hollow tubular element for an aerosol-generating article in accordance with a second embodiment of the present invention.

FIG. 5 shows a perspective view of a hollow tubular element 200 for an aerosol-generating article in accordance with a second embodiment of the present invention. The hollow tubular element 200 of the second embodiment differs from the hollow tubular element 100 of the first embodiment in that the first point 231 at the peripheral portion and the second point 232 at the peripheral portion are positioned closer to one another. In particular, the first point 231 at the peripheral portion and the second point 232 at the peripheral portion are spaced apart from each other by a distance of about zero millimetres. As such, the first fold line 241 and the second fold line 242 are also spaced apart from each other by a distance of about zero millimetres. The depth of the support element 230 is the same as the depth of the support element 130 and is about 2 millimetres.

Figure 6:
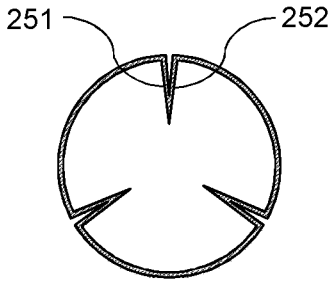
FIG. 6 shows a cross-sectional view of the upstream end face of the hollow tubular element of FIG. 5.

FIG. 6 shows a cross-sectional view of the upstream end face of the hollow tubular element 200. The angle formed between the first side wall 251 and the second side wall 252 is approximately zero degrees. Substantially the entirety of the first side wall 251 and substantially the entirety of the second side wall 252 are in contact with each other and are attached to each other by an adhesive. This may significantly increase the strength and the stiffness of the hollow tubular element in both the longitudinal direction and the transverse direction. This may also avoid the need to circumscribe the hollow tubular element 200 with a wrapper. As such, this may minimise the weight of the hollow tubular element 200 such that it is able to be assembled in the aerosol-generating article 1 using existing high speed aerosol-generating article assembly machines.

Figure 7:
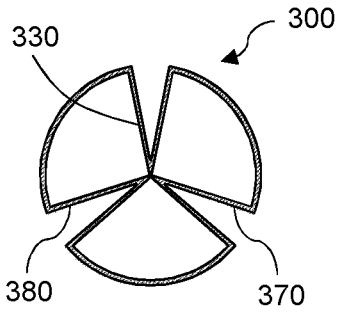
FIG. 7 shows a cross-sectional view of the upstream end face of a hollow tubular element for an aerosol-generating article in accordance with a third embodiment of the present invention.

FIG. 7 shows a cross-sectional view of the upstream end face of a hollow tubular element 300 for an aerosol-generating article in accordance with a third embodiment of the present invention. The hollow tubular element 300 of the third embodiment is generally the same as the hollow tubular element 100 of the first embodiment. However, the hollow tubular element 300 of the third embodiment differs from the hollow tubular element 100 of the first embodiment in that the support element 330 has a depth equal to about the radius of the hollow tubular element 300. As such, the support element 330 extends to the radial centre of the hollow tubular element 300. In particular, the tip of the support element 330 resides at or is adjacent to the radial centre of the hollow tubular element 300. In a similar manner to the hollow tubular element 100 of the first embodiment, the hollow tubular element 300 of the third embodiment comprises three identical support elements 330, 370, 380 equally spaced around the circumference of the hollow tubular element 300. As such, the support elements 330, 370, 380 divide the hollow inner region into three channels. In particular, the tips of the support elements 330, 370, 380 are adjacent to one another at the radial centre of the hollow tubular element 300.

Figure 8:
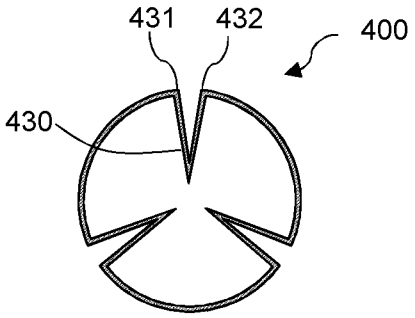
FIG. 8 shows a cross-sectional view of the upstream end face of a hollow tubular element for an aerosol-generating article in accordance with a fourth embodiment of the present invention.

FIG. 8 shows a cross-sectional view of the upstream end face of a hollow tubular element 400 for an aerosol-generating article in accordance with a fourth embodiment of the present invention. The hollow tubular element 400 is generally the same as the hollow tubular element 400 of the first embodiment, with the exception that the first point 431 at the peripheral portion and the second point 432 at the peripheral portion are positioned closer to one another. In particular, the first point 431 at the peripheral portion and the second point 432 at the peripheral portion are spaced apart from each other by a distance of about 0.8 millimetres. Furthermore, in FIG. 8, the depth of the support element 430 is now about 3 millimetres. In addition, in FIG. 8, the first side wall and the second side wall define an angle of about 15 degrees therebetween.

Figure 9:
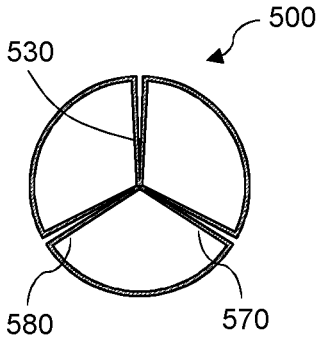
FIG. 9 shows a cross-sectional view of the upstream end face of a hollow tubular element for an aerosol-generating article in accordance with a fifth embodiment of the present invention.

FIG. 9 shows a cross-sectional view of the upstream end face of a hollow tubular element 500 for an aerosol-generating article in accordance with a fifth embodiment of the present invention. The hollow tubular element 500 is generally the same as the hollow tubular element 200 of the second embodiment, with the exception that the depth of the hollow tubular element 200 is about the same as the radius of the hollow tubular element 500. As such, the support element 530 extends to the radial centre of the hollow tubular element 500. In particular, the tip of the support element 530 resides at or is adjacent to the radial centre of the hollow tubular element 500. Similarly to the hollow tubular element 100 of the first embodiment and the hollow tubular element 200 of the second embodiment, the hollow tubular element 500 of the fifth embodiment comprises three identical support elements. As such, the three support elements of the hollow tubular element 500 divides the hollow region of the hollow tubular element 500 into three channels. In particular, the tips of the support elements 530, 370, 580 are adjacent to one another at the radial centre of the hollow tubular element 300.

Figure 10:
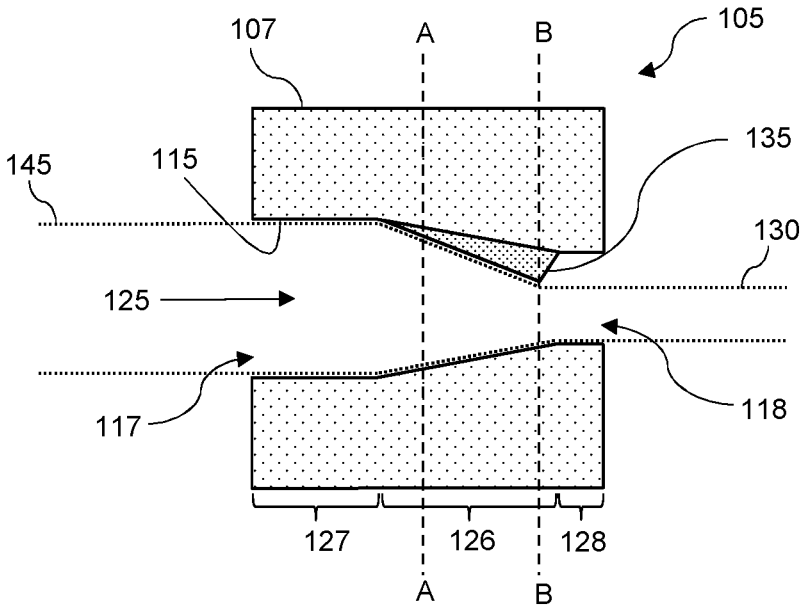
FIG. 10 shows a side view of an apparatus for forming a hollow tubular element for an aerosol-generating article, for example, in accordance with the first embodiment of the present invention.

FIG. 10 illustrates a method for forming a hollow tubular element for an aerosol-generating article, such as the hollow tubular element 100 of the first embodiment described above. The method comprises providing an apparatus 105 for forming the hollow tubular element. The apparatus 105 comprises a device 107. The device 107 has an internal surface 115 defining a channel 125. The channel 125 extends from an upstream opening 117 of the device 107 to a downstream opening 118 of the device 107.

The device 107 comprises a first section 126, a second section 127 and a third section 128. The first section is located between the second section 127 and the third section 128, as shown in FIG. 10.

The first section 126 of the device 107 comprises an internal projection 135 projecting into the channel 125. The internal projection 135 extends from an upstream end of the first section 126 of the device 107 to a downstream end of the first section 126 of the device 107. The channel 125 in the first section 126 of the device 107 is substantially frustoconical, wherein a diameter of the channel 125 at the upstream end of the first section 126 is greater than the diameter of the channel 125 at the downstream end of the first section 126.

The internal projection 135 is substantially pyramidal. The internal projection 125 has a substantially triangular cross section in both the longitudinal direction and the transverse direction. The internal projection 135 has a maximum transverse cross-sectional area at an apex of the internal projection 135 and tapers off at the upstream end of the first section 126 of the device 107. The internal projection comprises a first edge, wherein the first edge is adjacent to a portion of the internal surface of the device 107 that defines the channel 125. The first edge extends from the upstream end of the first section 126 of the device 107. The internal projection also comprises a second edge, wherein the second edge is also adjacent to the internal surface 115 of the device 107 that defines the channel. The second edge extends from the upstream end of the first section 126 of the device 107. The internal projection further comprises a third edge, wherein the third edge resides within the channel 125 and also extends from the upstream end of the first section 126 of the device 107.

Figure 11A:
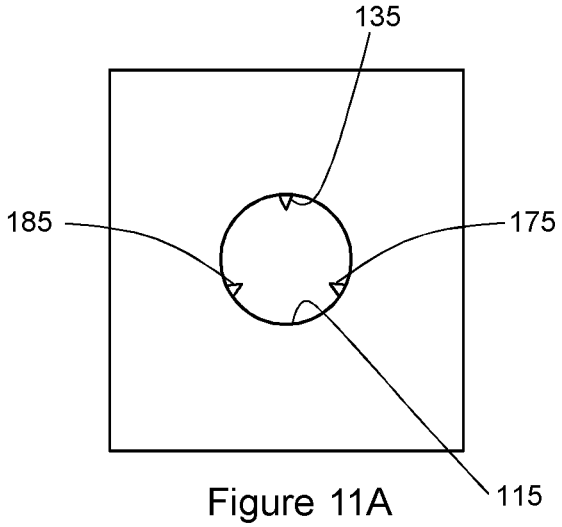
FIG. 11A shows a cross-sectional view of the apparatus of FIG. 10 as taken along plane A-A of FIG. 10.
Figure 11B:
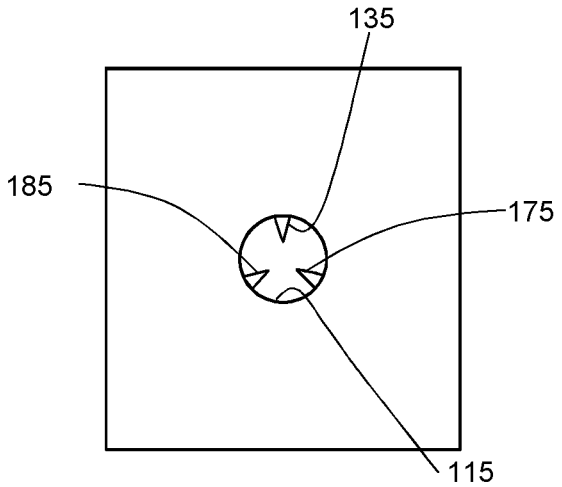
FIG. 11B shows a cross-sectional view of the apparatus of FIG. 10 as taken along plane B-B of FIG. 10.

A cross section of the internal projection 135 taken along plane A-A is shown in FIG. 11A. A cross section of the internal projection 135 taken along plane B-B is shown in FIG. 11B. As such, FIG. 11B shows a cross section of the internal projection 135 at the apex of the internal projection 135.

The second section 127 of the device 107 extends from the upstream opening 117 of the device 107 to the first section 126 of the device 107. The part of the channel 125 extending through the second section 127 of the device 107 is substantially cylindrical and has a diameter about the same as the diameter of the channel 125 at the upstream end of the first section 126.

The third section 128 of the device 107 extends from the first section 126 of the device 107 to the downstream opening 118 of the device 107. The part of the channel 125 extending through the third section 128 of the device 107 is substantially cylindrical and has a diameter about the same as the diameter of the channel 125 at the downstream end of the first section 126.

The method also comprises providing a hollow tube 145 formed from a sheet, wherein a circumference of the hollow tube 145 is about equal to the internal perimeter of a transverse cross section of the device 107 at the apex of the internal projection 135. A cross section of the hollow tube 145 is shown in FIG. 11A. The diameter of the channel 125 at the upstream end of the first section 126 is about the same as a diameter of the hollow tube 145. As such, the diameter of the hollow tube 145 is also about the same as the diameter of the part of the channel 125 extending through the second section 127 of the device 107.

The method further comprises passing the hollow tube 145 through the upstream opening 117 of the device 107, into the second section 127 of the device 107, along the channel 125.

The method further comprises passing the hollow tube 145 along the channel 125 and into contact with the internal projection 135 at the upstream end of the first section 126 of the device 107.

Figure 12A:
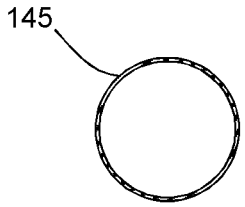
FIG. 12A shows a cross-sectional view of a hollow tube used to form a hollow tubular element for an aerosol-generating article, for example, in accordance with the first embodiment of the present invention.
Figure 12B:
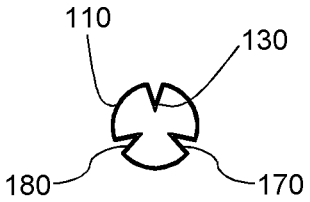
FIG. 12B shows a cross-sectional view of a hollow tubular element for an aerosol-generating article formed from the hollow tube of FIG. 12A and using the apparatus of FIG. 10.

The method further comprises passing the hollow tube 145 along the channel 125 through the first section 126 of the device 107, such that an outer surface of the hollow tube 145 is in contact with the internal surface 115 of the device 107. In particular, such that an outer surface of the hollow tube 145 is in contact with the internal projection 135. Due to the configuration of the first section 126 of the device 107, passing the hollow tube 145 along the first section 126 of the device 107 causes the hollow tube 145 to deform and conform to the internal shape of the first section of the device 107. In particular, the frustoconical shape of the channel 125 in the first section 126 when combined with the presence of the internal projection 135 in the first section 126, helps to shape the hollow tube 145 into a form having a reduced diameter and an internal folded projection forming a support element 130 as shown in FIG. 12B. Consequently, passing the hollow tube 145 through the first section 126 of the device 107 causes the hollow tube 145 to form: a first fold line at the first edge of the internal projection 135, a second fold line at the second edge of the internal projection 135; and a third fold line at the third edge of the internal projection 135. As such, passing the hollow tube 145 through the first section 126 of the device 107 forms a hollow tubular element formed from a sheet, the hollow tubular element comprising: a peripheral portion 110 defining a hollow inner region, and a support element 130; wherein the support element 130 depends from the peripheral portion along both a first fold line of the sheet and a second fold line of the sheet; and wherein the support element comprises a third fold line of the sheet residing within the hollow inner region. The hollow tube 145 and the hollow tubular element are shown in dotted lines in FIG. 10.

The method further comprises passing the hollow tubular element through the third section 128 of the device 107 and out of the channel 117 through the downstream opening 118 of the device 107. The third section 128 of the device 107 may assist with the exiting of the hollow tubular element out of the device 107. In addition, the third section 128 of the device 107 may help to retain the desired shape of the hollow tubular element after folding of the hollow tubular element.

As shown in FIGS. 11A and 11B, the internal projection 135 is a first internal projection 135 and the first section 126 of the device 107 comprises two additional internal projections: a second internal projection 175 and a third internal projection 185. Each of the internal projections 135, 175, 185 are identical to one another and are equally spaced around the circumference of the first section 126 of the device 107.

As such, as shown in FIG. 12B, the support element 130 of the hollow tubular element formed by passing the hollow tube 145 through the first section 126 of the device 107 is a first support element 130 and the hollow tubular element comprises two additional support elements: a second support element 170 and a third support element 180. Each of the support elements 130, 170, 180 are identical to one another and are equally spaced around the circumference of the hollow tubular element.

Figure 13:
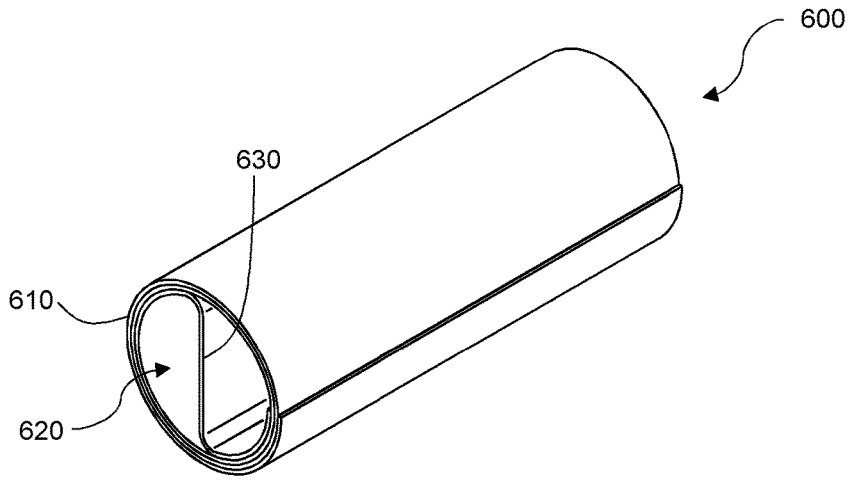
FIG. 13 shows a perspective view of a hollow tubular element for an aerosol-generating article in accordance with a sixth embodiment of the present invention.

FIG. 13 shows a perspective view of a hollow tubular element 600 for an aerosol-generating article in accordance with a sixth embodiment of the present invention. The hollow tubular element 600 comprises a peripheral portion 610, which defines a hollow inner region 620 of the hollow tubular element 600; and a support element 630.

Figure 14:
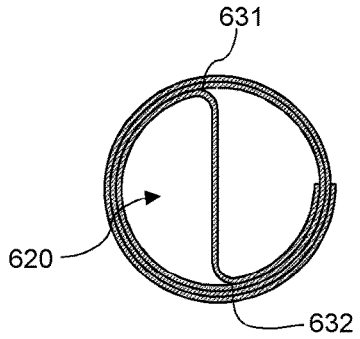
FIG. 14 shows a cross-sectional view of the upstream end face of the hollow tubular element of FIG. 13.

As shown in FIGS. 13 and 14, the peripheral portion 610 and the support element 630 are formed integrally from the same sheet of paper. In particular, the peripheral portion 610 is formed from between two and four parallel wound layers of the paper sheet, and the support element 630 is formed from a single layer of the paper sheet. More specifically, a section of the peripheral portion 610 is formed from two layers of the paper sheet, another section of the peripheral portion 610 is formed from three layers of the paper sheet, and a further section of the peripheral portion 610 is formed from four layers of the paper sheet.

As illustrated by FIG. 14, the support element 630 extends from a first point 631 at the peripheral portion 610 across the hollow inner region 620 through the radial centre of the hollow tubular element 600 to a second point 632 at the peripheral portion 610. The first point 631 at the peripheral portion 610 and the second point 632 at the peripheral portion 610 are about diametrically opposed to each other. The inner diameter of the hollow tubular element is about 6.9 millimetres. As such, the first point 631 at the peripheral portion 610 and the second point 632 at the peripheral portion 610 is spaced apart from each other by about 6.9 millimetres. The outer diameter of the hollow tubular element is about 7.2 millimetres.

The support element 630 comprises a substantially straight portion which extends from the first point 631 at the peripheral portion 610 to the second point 632 at the peripheral portion 610, when viewed from the upstream end of the hollow tubular element 600, as shown in FIG. 14.

The support element 630 depends from the peripheral portion 610 along a first fold line of the sheet, wherein the first fold line resides at the first point 631 at the peripheral portion 610. The support element 630 also depends from the peripheral portion 610 along a second fold line of the sheet, wherein the second fold line resides at the second point 632 at the peripheral portion 610. As such, the substantially straight portion also extends from the first fold line of the sheet to the second fold line of the sheet.

Figure 15:
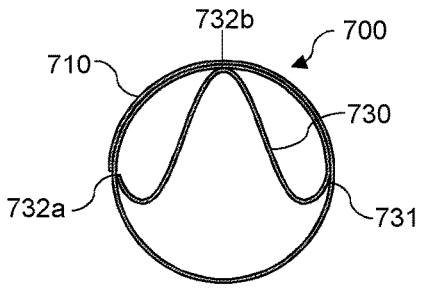
FIG. 15 shows a cross-sectional view of the upstream end face of a hollow tubular element for an aerosol-generating article in accordance with a seventh embodiment of the present invention.

FIG. 15 shows a cross-sectional view of the upstream end face of a hollow tubular element 700 for an aerosol-generating article in accordance with a seventh embodiment of the present invention. The hollow tubular element 700 comprises a peripheral portion 710 and a support element 730. The peripheral portion 710 and the support element 730 are formed integrally from the same sheet of paper. The peripheral portion 710 is formed from parallel wound layers of the sheet such that a section of the peripheral portion is formed from two layers of the sheet and another section of the peripheral portion 710 is formed from a single layer of the sheet.

The support element 730 extends from a first point 731 at the peripheral portion 710 across the hollow inner region to a second point 732*a* at the peripheral portion 710. In particular, the support element 730 comprises an end of the sheet, wherein the end of the sheet is in contact with the peripheral portion 710 at the second point 732*a* at the peripheral portion 710.

The support element 730 is substantially sinusoidal, when viewed from the upstream end of the hollow tubular element 700. The support element 730 comprises a plurality of peaks and troughs; in particular, the support element 730 comprises a peak and two troughs. The peak of the support element 730 is in contact with the peripheral portion 710 at a further point 732*b* at the peripheral portion 710.

As such, it will be appreciated that the portion of the sheet extending from the first point 731 at the peripheral portion 710 to the further point 732*b* at the peripheral portion 710 may be a first support element. In addition, the portion of the sheet extending from the further point 732*b* at the peripheral portion 710 to the second point 732*a* at the peripheral portion 710 may be a second support element.

Figure 16:
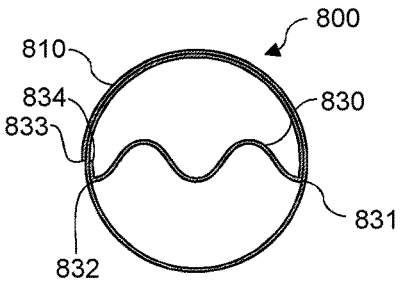
FIG. 16 shows a cross-sectional view of the upstream end face of a hollow tubular element for an aerosol-generating article in accordance with a eight embodiment of the present invention.

FIG. 16 shows a cross-sectional view of the upstream end face of a hollow tubular element 800 for an aerosol-generating article in accordance with an eight embodiment of the present invention. The hollow tubular element 800 comprises a peripheral portion 810 and a support element 830 formed integrally from the same sheet of paper. The sheet extends from a first end 833 of the sheet to a second end 834 of the sheet. The peripheral portion 810 is formed from parallel wound layers of the sheet such that a section of the peripheral portion 810 is formed from a single layer of the sheet and another section of the peripheral portion 810 is formed from two layers of the sheet.

The support element 830 extends from a first point 831 at the peripheral portion 810 across the hollow inner region to a second point 832 at the peripheral portion 810. In particular, the support element 830 depends from the peripheral portion 810 from both a first fold line and a second fold line of the sheet, wherein the first fold line resides at the first point 831 at the peripheral portion 810, and the second fold line resides at the second point 832 at the peripheral portion 810. The first point 831 at the peripheral portion 810 and the second point 832 at the peripheral portion 810 are about diametrically opposed to each other.

The portion of the sheet extending from the first end 833 of the sheet to the first point 831 at the peripheral portion 810, and the portion of the sheet extending from the second point 832 at the peripheral portion 810 to the second end 1034 of the sheet define the hollow inner region of the hollow tubular element 800. Accordingly, the peripheral portion 810 comprises the portion of the sheet extending from the first end 833 of the sheet to the first point 831 at the peripheral portion 810, and the portion of the sheet extending from the second point 832 at the peripheral portion 810 to the second end 834 of the sheet.

As shown in FIG. 16, the support element 830 is substantially sinusoidal, when viewed from the upstream end of the hollow tubular element 800. The support element 830 comprises a plurality of peaks and troughs; in particular, the support element 830 comprises two peaks and three troughs. This increases the surface area of the hollow tubular element 800 that may be in contact with the first element 10, in particular the aerosol-forming substrate 12, and the susceptor element 20. As such, this may increase the ability of the hollow tubular element 800 to prevent or restrict movement of both the first element 10, in particular the aerosol-forming substrate 12, and the susceptor element 20.

Figure 17:
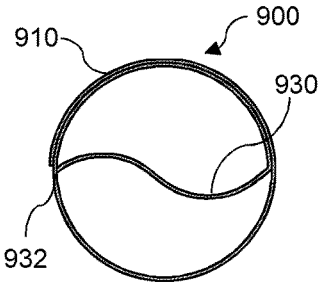
FIG. 17 shows a cross-sectional view of the upstream end face of a hollow tubular element for an aerosol-generating article in accordance with a ninth embodiment of the present invention.

FIG. 17 shows a cross-sectional view of the upstream end face of a hollow tubular element 900 for an aerosol-generating article in accordance with a ninth embodiment of the present invention. The hollow tubular element 900 is generally the same as the hollow tubular element 800 of the eighth embodiment, with the exception that a second end of the sheet resides at the second point 932 at the peripheral portion 910. As such, there is no portion of the sheet extending from the second point 932 at the peripheral portion 910 to the second end of the sheet. Accordingly, the support element 930 does not depend from the peripheral portion 910 along a second fold line of the sheet, wherein the second fold line resides at the second point 932 of the peripheral portion 910. In addition, the peripheral portion 910 does not comprise a portion of the sheet extending from the second point 932 at the peripheral portion 910 to the second end of the sheet.

Furthermore, the hollow tubular element 900 differs from the hollow tubular element 800 in that the support element 930 is substantially s-shaped, when viewed from the upstream end of the hollow tubular element 900.

The support element 930 extends through the radial centre of the hollow tubular element 900.

Figure 18:
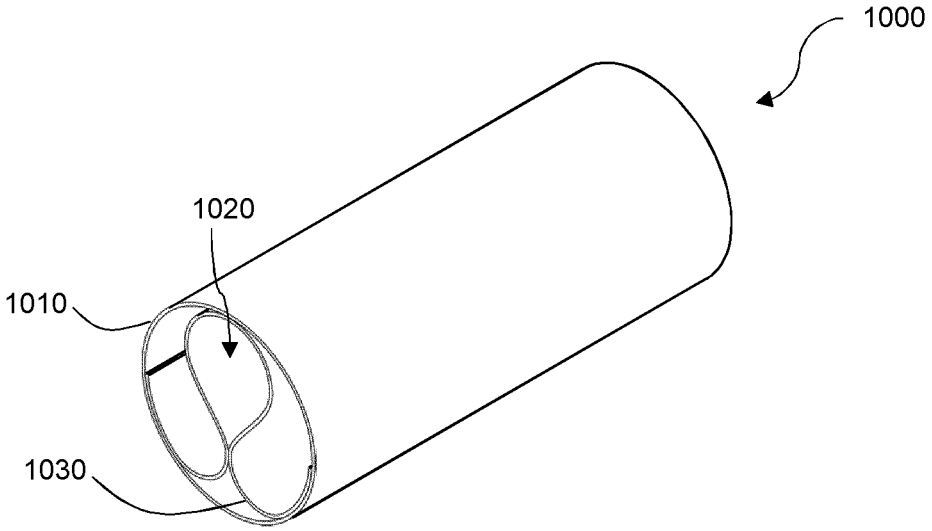
FIG. 18 shows a perspective view of a hollow tubular element for an aerosol-generating article in accordance with an tenth embodiment of the present invention.

FIG. 18 shows a perspective view of a hollow tubular element 1000 for an aerosol-generating article in accordance with a tenth embodiment of the present invention. The hollow tubular element 1000 comprises a peripheral portion 1010 which defines a hollow inner region 1020 of the hollow tubular element 1000. The hollow tubular element 1000 also comprises a support element 1030 formed from a sheet of paper. The peripheral portion 1010 comprises a tube that is distinct from the sheet which forms the support element 1030. That is, the tube is not integrally formed with the support element 1030.

Figure 19:
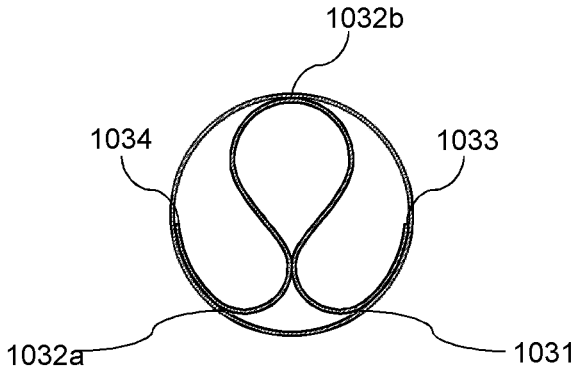
FIG. 19 shows a cross-sectional view of the upstream end face of the hollow tubular element of FIG. 18.

As shown in FIG. 19, a first end 1033 of the sheet is in contact with the tube up to a first point 1031 at the peripheral portion 1010, where it deflects away from the tube and into the hollow inner region 1020. A second end 1034 of the sheet is in contact with the tube up to a second point 1032*a* at the peripheral portion 1010, where it deflects away from the tube and into the hollow inner region 1020. As such, the support element 1030 extends from the first point 1031 at the peripheral portion 1010 across the hollow inner region 1020 to the second point 1032*a* at the peripheral portion 1010. In addition, the peripheral portion 1010 comprises: the tube, the portion of the sheet extending from the first end 1033 of the sheet to the first point 1031 at the peripheral portion 1010; and the portion of the sheet extending from the second point 1032*a* at the peripheral portion 1010 to the second end 1034 of the sheet.

The support element 1030 comprises a curved portion, when viewed from the upstream end of the hollow tubular element 100. In particular, the support element 1033 is substantially omega-shaped, when viewed from the upstream end of the hollow tubular element 1000. The support element 1030 is also in contact with the tube at a further point 1032*b* at the peripheral portion 1010. The support element 1030 divides the hollow inner region 1020 into four channels.

It will be appreciated that the portion of the sheet extending from the first point 1031 at the peripheral portion 1010 to the further point 1032*b* at the peripheral portion 1010 may be a first support element. In addition, the portion of the sheet extending from the further point 1032*b* at the peripheral portion 1010 to the second point 1032*a* at the peripheral portion 1010 may be a second support element. The first and second support elements divide the hollow inner region 1020 into four channels.

The sheet may be attached to the tube by an adhesive. In particular, the sheet may be attached to the tube at points where the sheet is in contact with the tube.

Figure 20:
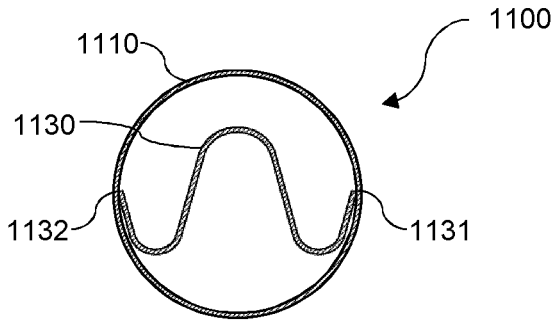
FIG. 20 shows a cross-sectional view of the upstream end face of a hollow tubular element for an aerosol-generating article in accordance with an eleventh embodiment of the present invention.

FIG. 20 shows a cross sectional view of the upstream end face of a hollow tubular element 1100 for an aerosol-generating article in accordance with an eleventh embodiment of the present invention. Similarly to the hollow tubular element 1000 of the tenth embodiment, the peripheral portion 1110 comprises a tube that is distinct from the sheet which forms the support element 1130. The support element 1130 is in contact with the peripheral portion 1110 at both a first point 1131 at the peripheral portion 1110 and a second point 1132 at the peripheral portion 1110. The support element extends from the first point 1131 at the peripheral portion 1110 across the hollow inner region to the second point 1132 at the peripheral portion 1110.

The support element 1130 has a wave profile, when viewed from the upstream end of the hollow tubular element 1100. In particular, the support element 1130 is substantially sinusoidal and comprises one peak and two troughs, when viewed from the upstream end of the hollow tubular element 1100.

The invention claimed is:

1. An aerosol-generating article comprising:

a first element comprising an aerosol-forming substrate, wherein the aerosol-forming substrate comprises one or more aerosol formers, and wherein the aerosol-forming substrate has an aerosol former content of between about 5 percent and about 30 percent on a dry weight basis; and a hollow tubular element disposed downstream of the first element, wherein the hollow tubular element comprises:

a peripheral portion defining a hollow inner region of the hollow tubular element; and a support element formed from a paper sheet and extending from a first point at the peripheral portion across the hollow inner region to a second point at the peripheral portion, wherein the hollow tubular element has an average weight of about 10 milligrams per millimetre length or less.

2. An aerosol-generating article according to claim 1, wherein the peripheral portion is formed from a sheet.

3. An aerosol-generating article according to claim 2, wherein the peripheral portion and the support element are integrally formed from a sheet.

4. An aerosol-generating article according to claim 1, wherein the sheet forming one or both of the peripheral portion and the support element has a basis weight of between about 35 grams per square metre and about 80 grams per square metre.

5. An aerosol-generating article according to claim 1, wherein the hollow tubular element has an overall weight of about 150 milligrams or less.

6. An aerosol-generating article according to claim 1, wherein the first point at the peripheral portion and the second point at the peripheral portion are adjacent to each other.

7. An aerosol-generating article according to claim 1, wherein the support element comprises a tip, the tip being positioned within the hollow inner region.

8. An aerosol-generating article according to claim 1, wherein the support element depends from the peripheral portion along a first fold line of the sheet, wherein the first fold line resides at the first point at the peripheral portion.

9. An aerosol-generating article according to claim 8, wherein the support element depends from the peripheral portion along a second fold line of the sheet, wherein the second fold line resides at the second point at the peripheral portion.

10. An aerosol-generating article according to claim 9, wherein the support element comprises a third fold line of the sheet.

11. An aerosol-generating article according to claim 1, wherein a cross section of the support element comprises a curved portion.

12. An aerosol-generating article according to claim 1, wherein the support element comprises a plurality of peaks and troughs, when viewed from an upstream end of the hollow tubular element.

13. An aerosol-generating article according to claim 1, wherein the support element is configured so that the hollow inner region consists of a single channel.

14. An aerosol-generating article according to claim 1, wherein the support element extends through a radial centre of the hollow tubular element.

15. An aerosol-generating article according to claim 1, further comprising a ventilation zone at a location along the hollow tubular element.

* * * * *